US009651295B2

(12) United States Patent
Kim et al.

(10) Patent No.: US 9,651,295 B2
(45) Date of Patent: May 16, 2017

(54) REFRIGERATOR

(71) Applicant: LG ELECTRONICS INC., Seoul (KR)

(72) Inventors: Hyunbum Kim, Seoul (KR); Jindong Kim, Seoul (KR); Jihyun Im, Seoul (KR); Jaeyoul Lee, Seoul (KR); Ayoung Choo, Seoul (KR); Nami Kim, Seoul (KR); Myunghwan Kim, Seoul (KR); Raeyoung Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/898,373

(22) PCT Filed: Jun. 16, 2014

(86) PCT No.: PCT/KR2014/005268

§ 371 (c)(1),
(2) Date: Dec. 14, 2015

(87) PCT Pub. No.: WO2014/200320

PCT Pub. Date: Dec. 18, 2014

(65) Prior Publication Data

US 2016/0138854 A1 May 19, 2016

(30) Foreign Application Priority Data

Jun. 14, 2013 (KR) ..... 10-2013-0068247
Jun. 14, 2013 (KR) ..... 10-2013-0068248
(Continued)

(51) Int. Cl.
*F25D 23/02* (2006.01)
*F25D 23/06* (2006.01)
(Continued)

(52) U.S. Cl.
CPC ..... *F25D 23/028* (2013.01); *E05D 5/02* (2013.01); *E05D 5/065* (2013.01); *E05D 7/081* (2013.01);
(Continued)

(58) Field of Classification Search
CPC ..... F25D 23/02; F25D 23/025; F25D 23/028; F25D 2323/023; F25D 2323/024; E05D 5/02; E05D 5/065; E05D 7/081
See application file for complete search history.

(56) References Cited

U.S. PATENT DOCUMENTS 2,122,680 A 7/1938 Dart
5,966,963 A 10/1999 Kovalaske
(Continued)

FOREIGN PATENT DOCUMENTS

| | | |
|---|---|---|
| FR | 846594 | 9/1939 |
| GB | 537114 | 6/1941 |
| JP | S5785184 | 9/2015 |

OTHER PUBLICATIONS

International Search Report dated Oct. 20, 2014 for Application No. PCT/KR2014/005268, 2 pages.
(Continued)

*Primary Examiner* — Daniel Rohrhoff
(74) *Attorney, Agent, or Firm* — Fish & Richardson P.C.

(57) ABSTRACT

Disclosed herein is a refrigerator including a cabinet (10) defining a first storage region (2) for storing food, a door (20) opening and closing the first storage region (2) and filled with a thermal insulator therein, a gasket (26) provided on an inner surface of the door (20) and sealing the first storage region (2) from outdoor air by forming a sealing boundary when the door (20) closes the first storage region (2), a first hinge member (40) rotatably connecting the door (2) to the cabinet (10), a container (100) defining a second
(Continued)

storage region for storing food and received in the first storage region (2), a second hinge member (200) rotatably connecting the door (20) to the container (100), and a connection member (260) structurally coupled to the second hinge member (200) within the door (20), in order to prevent distortions of a direction and a position of a rotary shaft (206) of the second hinge member (200) relative to a rotary shaft (42) of the first hinge member (40).

40 Claims, 13 Drawing Sheets

(30) Foreign Application Priority Data

Jun. 14, 2013 (KR) ..... 10-2013-0068251
Oct. 18, 2013 (KR) ..... 10-2013-0124615

(51) Int. Cl.

| | |
|---|---|
| ***F25D 25/00*** | (2006.01) |
| ***F25D 25/02*** | (2006.01) |
| ***E05D 5/02*** | (2006.01) |
| ***E05D 11/00*** | (2006.01) |
| ***E05D 7/081*** | (2006.01) |
| ***F25D 23/08*** | (2006.01) |
| *E05D 5/06* | (2006.01) |
| *F25D 23/04* | (2006.01) |
| *E05D 3/02* | (2006.01) |
| *E05D 5/10* | (2006.01) |

(52) U.S. Cl.

CPC ..... *E05D 11/0054* (2013.01); *F25D 23/025* (2013.01); *F25D 23/062* (2013.01); *F25D 23/065* (2013.01); *F25D 23/087* (2013.01); *F25D 25/005* (2013.01); *F25D 25/022* (2013.01); *E05D 3/022* (2013.01); *E05D 5/06* (2013.01); *E05D 5/10* (2013.01); *E05D 2005/067* (2013.01); *E05Y 2600/41* (2013.01); *E05Y 2800/71* (2013.01); *E05Y 2900/31* (2013.01); *F25D 23/04* (2013.01); *F25D 2201/12* (2013.01); *F25D 2323/024* (2013.01)

(56) References Cited

U.S. PATENT DOCUMENTS

| | | | | |
|---|---|---|---|---|
| 8,147,015 | B2 * | 4/2012 | Kim | E05D 5/12 16/262 |
| 9,080,808 | B2 * | 7/2015 | Choi | F25D 21/04 |
| 2010/0154457 | A1 | 6/2010 | Kim et al. | |
| 2012/0096872 | A1 * | 4/2012 | Cheong | F25C 5/005 62/3.3 |
| 2013/0170897 | A1 * | 7/2013 | Kang | F25D 23/04 403/321 |
| 2015/0241116 | A1 * | 8/2015 | Choi | E05B 65/0042 312/404 |
| 2016/0061511 | A1 * | 3/2016 | Park | F25D 11/02 312/404 |
| 2016/0123654 | A1 * | 5/2016 | Lee | E05D 5/02 312/404 |
| 2016/0138855 | A1 * | 5/2016 | Choo | E05B 47/06 312/405.1 |

OTHER PUBLICATIONS

Extended European Search Report in European Application No. 14811325.1-1605/3008407, dated Jan. 24, 2017, 7 pages (with English translation).

Extended European Search Report in European Application No. 14811011.7.-1605/3008406, dated Mar. 10, 2017, 7 pages (with English translation).

* cited by examiner

Fig. 19
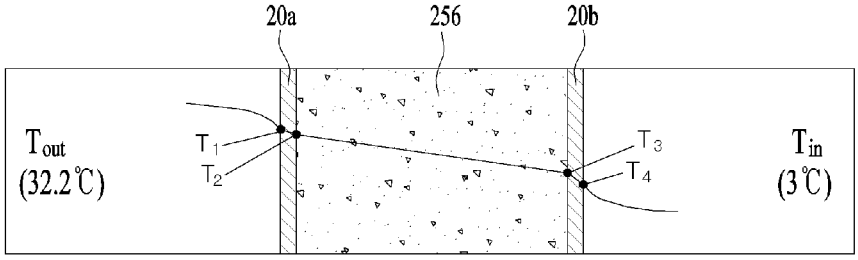
Fig. 20
| | OUTSIDE | Out case | THERMAL INSULATOR | ABS | INSIDE |
|---|---|---|---|---|---|
| t[m] | | 0.0005 | 0.0119 | 0.0015 | |
| k[W/m ℃] | | 80 | 0.0188 | 0.1 | |
| Temp[℃] | T1 | T2 | T3 | T4 | $T_{in}$ |
| | 27.9 | 27.9 | 6.2 | 5.6 | 3.0 |
Fig. 21
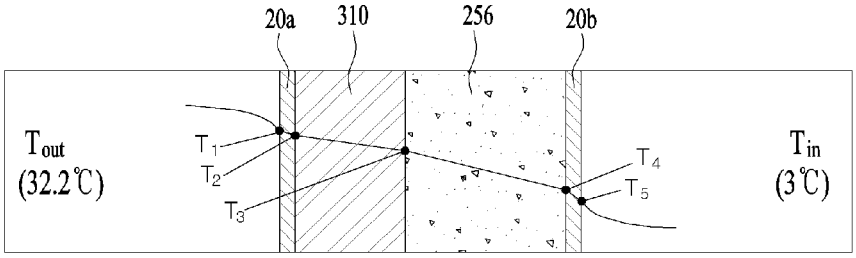
Fig. 22
| | OUTSIDE | Out case | VIP(8t) | THERMAL INSULATOR | ABS | INSIDE |
|---|---|---|---|---|---|---|
| t[m] | | 0.0005 | 0.008 | 0.0039 | 0.0015 | |
| k[W/m ℃] | | 80 | 0.0068 | 0.0188 | 0.1 | |
| Temp[℃] | T1 | T2 | T3 | T4 | T5 | $T_{in}$ |
| | 29.9 | 29.9 | 8.5 | 4.7 | 4.4 | 3.0 |

REFRIGERATOR

CROSS REFERENCE TO RELATED APPLICATIONS

This application is a U.S. National Phase Application under 35 U.S.C. §371 of International Application PCT/KR2014/005268, filed on Jun. 16, 2014, which claims the benefit of Korean Application Nos. 10-2013-0068251, 10-2013-0068247, and 10-2013-0068248, filed on Jun. 14, 2013, and Korean Application No. 10-2013-0124615 filed on Oct. 18, 2013, the entire contents of which are hereby incorporated by reference in their entireties.

TECHNICAL FIELD

The present invention relates to a refrigerator, and more particularly, to a refrigerator having a separate storage region in addition to a main storage region of the refrigerator such that a user has improved convenience in use of the refrigerator.

BACKGROUND ART

In general, a refrigerator is an apparatus which maintains the temperature of a storage region provided in the refrigerator to a predetermined temperature to keep food frozen or refrigerated, using a refrigeration cycle configured of a compressor, a condenser, an expansion valve, and an evaporator. The refrigerator typically includes storage regions such as a freezing chamber and a refrigerating chamber.

The refrigerator is also classified according to positions of the freezing chamber and the refrigerating chamber. For example, the refrigerator may be classified into a top mount type refrigerator in which the freezing chamber is arranged above the refrigerating chamber, a bottom freezer type refrigerator in which the freezing chamber is arranged beneath the refrigerating chamber, a side by side type refrigerator in which the freezing chamber and the refrigerating chamber are arranged to the left and right by a partition wall, and the like.

The freezing chamber and the refrigerating chamber are provided within a cabinet defining an external appearance of the refrigerator, and are respectively opened and closed by a freezing chamber door and a refrigerating chamber door. The freezing chamber door and the refrigerating chamber door are rotatably mounted to the cabinet, and are each provided with a gasket for sealing the inside of the storage chamber.

In recent years, there has been proposed a refrigerator for meeting various consumers' demands and preventing a loss of cold air due to frequent opening and closing of a door. For example, there is disclosed a refrigerator which has a separate storage region (hereinafter, referred to as "an auxiliary storage region" for convenience) in addition to storage regions of the refrigerator such as a freezing chamber and a refrigerating chamber and is designed to be accessible to the auxiliary storage region without opening a door of the refrigerator.

For instance, Korean Patent Laid-Open Publication No. 10-2010-0130508 discloses a refrigerator which has an auxiliary storage region in a main door of the refrigerator, installs an auxiliary door to a front surface of the main door, and is designed to be accessible to the auxiliary storage region by opening and closing only the auxiliary door.

However, such a refrigerator may cause a leakage of cold air between a cabinet and the main door and between the main door and the auxiliary door.

In order to prevent the leakage of cold air, a gasket is used each between the cabinet and the main door and between the main door and the auxiliary door. Accordingly, parts to be sealed by the gasket are increased, resulting in an increase in loss of cold air by the increased parts and thus an increase in power consumption.

Accordingly, the increase in parts to be sealed by the gasket may increase a loss region of cold air in itself and may increase concern about dew formation due to a temperature difference around the gasket. That is, this means that an installation region of a heater has to be increased in order to prevent dew formation around the gasket. Consequently, power consumption may be increased and the door may have a complicated structure.

Korean Patent Laid-Open Publication No. 10-2011-0040567 discloses a refrigerator which uses only one door by locating an auxiliary storage region within a cabinet. However, it is technically very difficult to locate the auxiliary storage region within the cabinet.

In order for the auxiliary storage region to rotate independently of or together with the refrigerator door, a rotary mechanism such as a hinge should be provided outside the cabinet. In addition, the refrigerator door should be sealed such that the refrigerator door comes into contact with a front surface of the cabinet to prevent a leakage of cold air. However, the refrigerator door is not easy to be sealed by interference with the rotary mechanism of the auxiliary storage region.

The above patent Publication discloses a linker which allows the auxiliary storage region to be rotatable relative to the cabinet by installing a rotary mechanism inside the cabinet. The linker has a structure by which the auxiliary storage region slides to the outside of the cabinet and is then rotated. Accordingly, there are problems in that a coupling structure between the auxiliary storage region and the cabinet is complicated and particularly a hinge connecting them has a very complicated structure. In addition, due to characteristics of the hinge connecting the auxiliary storage region and the cabinet, the auxiliary storage region may be deflected or the hinge may be deformed by loads of the auxiliary storage region. Particularly, there is a problem in that the hinge, through which a first link is slidably connected to a second link, is very weak to loads perpendicular to a sliding direction. Thus, when the auxiliary storage region is rotated relative to the cabinet independently of the door in an opened state of the door, the loads of the auxiliary storage region may be concentrated on the hinge. Consequently, the hinge may be severely deformed and the auxiliary storage region may be deflected.

Meanwhile, in the refrigerator having such a structure, the refrigerator door and the auxiliary storage region need to be simultaneously opened in order for a user to have access to a storage space within the cabinet of the refrigerator. However, as disclosed in the above patent Publication, since opening operations of the refrigerator door and the auxiliary storage region do not coincide with each other, there is inconvenience in that the refrigerator door and the auxiliary storage region are not simultaneously opened.

In order for the auxiliary storage region to be rotatably opened independently of the cabinet while being received within the cabinet of the refrigerator, various other structures have been proposed.

For instance, Korean Patent Laid-Open Publication No. 10-2013-0024207 published by the present applicant discloses a rotary mechanism having other structure for receiving an auxiliary storage region within a cabinet of a refrigerator. This technique teaches a method in which the auxiliary storage region is rotated relative to a refrigerator door instead of the cabinet, and the auxiliary storage region is connected to the refrigerator door by an articulated pivot linker. In the structure in which the auxiliary storage region is rotated relative to a refrigerator door, although this technique takes account of rotation interference between the refrigerator door and the auxiliary storage region, it is not proper to store heavy food in the refrigerator since the more joints the rotary mechanism has the weaker it is to the loads of the auxiliary storage region.

Meanwhile, Korean Patent Laid-Open Publication No. 10-2013-0079770 published by the present applicant discloses a structure in which an auxiliary storage region is seated to a cabinet while being received within the cabinet of a refrigerator in a closed state of a refrigerator door in the cabinet. In this structure, when a user intends to open only the refrigerator door, the auxiliary storage region is left within the cabinet. On the other hand, when a user intends to have access to a storage space of the cabinet, the auxiliary storage region may be opened together with the refrigerator door by attaching the auxiliary storage region inside the refrigerator door.

This technique enables loads applied to the auxiliary storage region to be transferred toward the cabinet though a hinge of the refrigerator door, by opening the auxiliary storage region dependent upon the refrigerator door without rotatably opening the auxiliary storage region independently of the cabinet. However, the technique is problematic in that the structure is very complicated and the auxiliary storage region is not operated independently of the refrigerator door.

Thus, although various methods have been proposed in order to minimize a sealing part for preventing a leakage of cold air by receiving the openable auxiliary storage region and the refrigerator door within the cabinet of the refrigerator, the methods have problems in terms of the complicated structure, deflection by weight of food, and interlocking with the refrigerator door.

Particularly, the proposed conventional techniques attempt technical access to a new form, instead of applying the hinge mechanism configured of the single component provided in the refrigerator door. This means that it is not easy to receive the auxiliary storage region within the cabinet of the refrigerator.

DISCLOSURE OF INVENTION

Technical Problem

An object of the present invention devised to solve the problems is to provide a refrigerator capable of suppressing an increase in power consumption while improving user's convenience.

Another object of the present invention devised to solve the problems is to provide a refrigerator which is independently rotatable while an auxiliary storage region is received within a cabinet. Thus, the object of the present invention is to provide the refrigerator capable of having a simple structure and of opening and closing the auxiliary storage region independently of or together with a refrigerator door.

Another object of the present invention devised to solve the problems is to provide a refrigerator having increased reliability by preventing deflection and deformation of an auxiliary storage region itself due to weight of food stored in the auxiliary storage region and by preventing deflection of a rotary mechanism itself provided for rotation of the auxiliary storage region. That is, the object of the present invention is to provide the refrigerator capable of solving a problem in that the auxiliary storage region is not received within the cabinet of the refrigerator due to torsion of the auxiliary storage region or deformation of a center of rotation of the rotary mechanism of the auxiliary storage region.

Another object of the present invention devised to solve the problems is to provide a refrigerator in which an auxiliary storage region may rotate relative to a refrigerator door rather than a cabinet in order to maximally utilize a storage space of the cabinet of the refrigerator and a storage space of the auxiliary storage region. To this end, the object of the present invention is to provide the refrigerator capable of preventing interference between a rotary mechanism of the auxiliary storage region installed to the refrigerator door and the refrigerator door. In addition, the object of the present invention is to provide the refrigerator capable of securely preventing a leakage of cold air by effectively performing sealing between the refrigerator door and the cabinet even when the rotary mechanism is installed to the refrigerator door.

Another object of the present invention devised to solve the problems is to provide a refrigerator capable of preventing deterioration of thermal insulation performance by a rotary mechanism installed to a refrigerator door.

A further object of the present invention devised to solve the problems is to provide a refrigerator in which an auxiliary storage region may be opened and closed independently of a door in an opened state of only the door and the auxiliary storage region may be closed together by closing only the door regardless of a rotation position of the auxiliary storage region with respect to the door. Thus, the object of the present invention is to provide the refrigerator capable of realizing various usage forms of the door and the auxiliary storage region.

Solution to Problem

The object of the present invention can be achieved by providing a refrigerator including a cabinet defining a first storage region for storing food, a door which opens and closes the first storage region and is filled with a thermal insulator therein, a gasket which is provided on an inner surface of the door and seals the first storage region from outdoor air by forming a sealing boundary when the door closes the first storage region, a first hinge member which rotatably connects the door to the cabinet, a container which defines a second storage region for storing food and is received in the first storage region, a second hinge member which rotatably connects the door to the container, and a connection member which is structurally coupled to the second hinge member within the door, in order to prevent distortions of an axial direction and a position of a rotary shaft of the second hinge member relative to a rotary shaft of the first hinge member. The connection member may be structurally directly or indirectly connected to the second hinge member.

The connection member is preferably configured to be buried by the thermal insulator within the door. Accordingly, the connection member may be securely fixed within the door by bonding force generated between the connection member and the thermal insulator. In addition, by such a relation between the connection member and the thermal insulator, loads or vibration transferred to the connection member may be uniformly distributed to the entire door. Moreover, the second hinge member may be securely supported on the door.

The connection member may extend into the thermal insulator by being individually connected to each of the upper and lower second hinge members of the container. Of course, the upper and lower second hinge members may be connected to each other through the connection member so as to be buried in the thermal insulator.

Meanwhile, the connection member may also be connected to each of the upper and lower first hinge members provided at the respective upper and lower portions of the door. In addition, all of the upper and lower second hinge members and the upper and lower first hinge members may be connected through the connection member.

By a structurally direct or indirect connection relation through the connection member, it may be possible to prevent deflection of the second hinge member due to the loads of the container and a state in which a center of rotation of the first hinge member is linearly aligned with a center of rotation of the second hinge member may be always securely maintained.

In order to further increase bonding force between the connection member and the thermal insulator, the connection member may have various shapes and structures. That is, it may be possible to further increase bonding force by an increase in coupling area.

The connection member is preferably formed with a through hole configured such that the thermal insulator passes through the through hole while being filled through the through hole.

The connection member may be formed in a plate shape and may include a planar portion having a wide surface toward a front surface of the door. In addition, the connection member may include a bending portion.

The planar portion may be substantially formed in parallel with the front surface of the door and the bending portion may be formed in a direction intersecting with the front surface of the door. The planar portion and the bending portion are preferably with through holes into which a foamed thermal insulator is inserted.

Each of the through holes is formed in the form of a vertical slot. The through hole may further increase bonding force for overcoming moment applied to the first and second hinge members, together with the bending portion. Meanwhile, the planar portion of the connection member is formed with a recess in the forward and backward direction thereof, and may enhance rigidity against the moment together with the bending portion. The through hole may be formed on the recess.

In accordance with the embodiment of the present invention, the door may include an outside panel defining a front external appearance of the door and an inside panel defining a rear external appearance of the door, and the thermal insulator is preferably filled in an inner space of the door formed by the inside panel and the outside panel. Here, it is preferable that the structural coupling between the second hinge member and the connection member is first performed within the door, and then the thermal insulator is filled therein. Accordingly, since the connection member may be buried in the thermal insulator, the structural coupling between the second hinge member and the connection member may be securely maintained even when the thermal insulator is filled.

It is preferable that the connection member is provided regardless of the inside panel, the outside panel, and thermal insulator, and the connection member is structurally directly or indirectly coupled with the inside panel and/or the outside panel within the door so as to distribute loads applied the second hinge member to the door or transfer the loads to the first hinge member.

The connection member is preferably provided to vertically extend at one side within the door, so as to be connected to the second hinge member provided at each of upper and lower portions of the door. Thus, two second hinge members, which are respectively provided at upper and lower portions, may be structurally directly or indirectly connected to the connection member. Consequently, centers of rotation of the two second hinge members may be securely maintained.

In accordance with the embodiment of the present invention, the refrigerator may include a mounting member forming a receiving portion of the second hinge member. The mounting member may be directly coupled to the second hinge member. The mounting member may be directly connected to the connection member within the door.

Specifically, the mounting member may form a second hinge member receiving portion for receiving at least a portion of the second hinge member having a rotation portion. Accordingly, the rotary shaft of the second hinge member is preferably inserted into the mounting member. The refrigerator may further include a bracket which is provided between the inside panel and the mounting member and is fixed to the inside panel.

After the mounting member, the connection member, the bracket, and the inside panel are first coupled to each other, the thermal insulator is preferably filled therein. Since such components have sufficient rigidity and are coupled to each other, alignment may be not damaged during filling of the thermal insulator. After completion of the thermal insulator filling, the alignment may be more securely maintained.

The refrigerator may further include coupling members which respectively extend in left and right directions of the door at upper and lower portions of the connection member to be coupled with the rotary shaft of the first hinge member. The coupling members may form a space, in which the thermal insulator is filled, together with the inside panel and the outside panel. The coupling between the connection member and the coupling member is preferably performed within the door. Accordingly, the loads transferred by the connection member may be transferred to the coupling member and the loads transferred to the coupling member may be again transferred to the first hinge member. The loads transferred to the first hinge member may be transferred to the rigid cabinet.

The first and second hinge members may be respectively provided as two members at upper and lower portions of the door. The connection member may be provided between the lower first hinge member and the lower second hinge member.

The lower second hinge member may be located over the lower first hinge member, and the connection member may structurally connect a rotary shaft of the lower first hinge member and a rotary shaft of the lower second hinge member which are spaced apart from each other.

The refrigerator may further include a second hinge bush interposed between the connection member and the second hinge member, and the second hinge member may be rotatably coupled to the second hinge bush. The second hinge bush may form at least a portion of the receiving portion for receiving the second hinge member.

The lower first hinge member may include a connection piece fixed to the door, and the connection member is preferably coupled to the connection piece within the door.

Accordingly, the loads applied to the second hinge member may be transferred to the lower first hinge member through the connection member. The loads transferred to the lower first hinge member may be transferred to the rigid cabinet.

It is preferable that one side of the second hinge member is fixed to the container within the sealing boundary and the other side thereof is rotatably connected to the door. Of course, the other side of the second hinge member may also be located within the sealing boundary.

It is preferable that the rotary shaft of the first hinge member is vertically and linearly aligned with the rotary shaft of the second hinge member.

In accordance with the embodiment of the present invention, the refrigerator may include a latch for selectively coupling the container to the door. The container and the door may be opened together during coupling of both through the latch and only the door may be opened during decoupling of both through the latch.

In another aspect of the present invention, provided herein is a refrigerator including a cabinet defining a first storage region for storing food, a door which opens and closes the first storage region, a gasket which is provided on an inner surface of the door and seals the first storage region from outdoor air by forming a sealing boundary when the door closes the first storage region, a first hinge member which rotatably connects the door to the cabinet, a container which defines a second storage region for storing food within the sealing boundary and is received in the first storage region, and a second hinge member which is rotatably connected to the door, and is connected to the container within the sealing boundary to rotate the container relative to the door, wherein all of a rotation trajectory space region of the container relative to the door configures to be in a rotation trajectory space region of the door relative to the cabinet, so that the container is always received in the first storage region when the door closes the first storage region.

Here, the rotation trajectory space region means a three-dimensional region generated according to rotation of a two-dimensional plane having a specific cross-sectional area on the basis of the rotary shaft.

In the present embodiment, all of the rotation trajectory space region of the container formed according to rotation of the container relative to the door in the outside of a second storage region is preferably included in the rotation trajectory space region of the gasket formed according to rotation of the door.

Accordingly, it may be possible to realize usage forms such as opening of only the door, opening of the door together with the container, opening of the container in an opened state of only the door, closing of only the container in an opened state of the door together with the container, and closing of only the container in a separately opened state of the door and the container. In addition, in a state in which the door and the container are separately opened (for example, opening of the door relative to the cabinet by 90° and opening of the container relative to the cabinet by 50°), the container may be closed together by closing the door regardless of a rotation angle of the container relative to the door. Of course, since the container is received in the first storage region by closing the door, the first storage region and the auxiliary storage region may be sealed from outdoor air through the gasket provided only between the door and the cabinet.

In another aspect of the present invention, provided herein is a refrigerator including a cabinet defining a first storage region for storing food, a door which opens and closes the first storage region and is filled with a thermal insulator therein, a gasket which is provided on an inner surface of the door and seals the first storage region from outdoor air by forming a sealing boundary when the door closes the first storage region, a first hinge member which rotatably connects the door to the cabinet, a container which defines a second storage region for storing food within the sealing boundary and is received in the first storage region, a second hinge member which is rotatably connected to the door, and is connected to the container within the sealing boundary to rotate the container relative to the door, and a connection member which is structurally coupled to the second hinge member within the door, in order to prevent distortions of an axial direction and a position of a rotary shaft of the second hinge member relative to a rotary shaft of the first hinge member, wherein all of a rotation trajectory space region of the container relative to the door configures to be in a rotation trajectory space region of the door relative to the cabinet, so that the container is always received in the first storage region when the door closes the first storage region.

In another aspect of the present invention, provided herein is a refrigerator including a cabinet defining a first storage region for storing food, a door which opens and closes the first storage region, a gasket which is provided on an inner surface of the door and seals the first storage region from outdoor air by forming a sealing boundary when the door closes the first storage region, a first hinge member which has a rotary shaft and rotatably connects the door to the cabinet out of the sealing boundary, a container which defines a second storage region for storing food and is received in the first storage region, and a second hinge member which is fixed, at one side thereof, to the container within the sealing boundary while being rotatably connected, at the other side thereof, to the door, the second hinge member having a rotary shaft which is vertically and linearly aligned with the rotary shaft of the first hinge member.

In a further aspect of the present invention, provided herein is a refrigerator including a cabinet having at least one storage chamber for storing food, a first hinge member which includes a fixed portion at one side thereof and a rotation portion at the other side thereof, the fixed portion being fixedly supported by the cabinet, at least one door which has an outer side surface and an inner side surface, a thermal insulator being filled therebetween, the door being rotatably connected with a rotary shaft of the first hinge member to open and close the storage chamber, the door being rotatably provided relative to the cabinet, the door having a gasket forming a sealing boundary of cold air on the inner side surface, a container which defines a separate auxiliary storage region selectively separated from the storage chamber and received within the storage chamber of the cabinet, a second hinge member which has a fixed portion at one side thereof, a rotation portion at the other side thereof, and a connection portion connecting the fixed portion and the rotation portion, the fixed portion being fixedly supported by the container, the rotation portion being rotatably connected within the sealing boundary of the door, and a connection member connected to the rotation portion of the second hinge member, at least a portion of the connection member being formed to extend into the thermal insulator of the door.

The container may be simultaneously decoupled from the cabinet together with the door or be decoupled from the cabinet independently of the door, so as to be rotatable, through the first and second hinge members. Particularly, the container may be securely and smoothly supported to be rotatable relative to the door, through the connection member.

The sealing boundary of the door is preferably provided therein with a second hinge member receiving portion in which the rotation portion of the second hinge member is rotatably seated.

The connection member is preferably connected to the rotation portion of the second hinge member through the receiving portion.

The rotation portion of the second hinge member seated in the receiving portion may be linearly aligned with the rotation portion of the first hinge member located outside the sealing boundary. The linear alignment is preferably a vertical and linear alignment.

At least a portion of the rotation portion of the first hinge member may be arranged to overlap with at least a portion of the rotation portion of the second hinge member.

A portion of the receiving portion may extend from the inside of the sealing boundary of the door to the outside of the sealing boundary over the gasket.

The gasket may include a fixed portion configured such that a portion of the fixed portion is fixedly inserted into the door, and the rotation portion of the second hinge member may be seated at a position biased toward the outside of the sealing boundary from a center of the fixed portion of the gasket.

At least a portion of the connection member, which is connected to the rotation portion of the second hinge member to extend into the thermal insulator, may extend to the rotation portion of the first hinge member.

The refrigerator may further include coupling members each of which extends in a direction intersecting with the connection member while at least a portion of the coupling member is exposed to the outside of the door, the coupling members being respectively connected to the rotation portion of the first hinge member and the connection member.

The coupling members may form a space, in which the thermal insulator is filled, together with the inner side surface and the outer side surface of the door.

The second hinge member of the container may have an upper second hinge member and a lower second hinge member, the upper and lower second hinge members may be rotatably supported within the sealing boundary of the door, and at least a portion of the connection member may be formed to connect the upper and lower second hinge members.

At least a portion of the connection member further may extend to the rotation portion of the first hinge member.

The connection member may extend between the outer side surface and the inner side surface of the door in a vertical direction of the door, and the connection member may include at least one planar portion which is substantially parallel with the outer side surface of the door.

The connection member may extend between the outer side surface and the inner side surface of the door in a vertical direction of the door, and the connection member may include at least one planar portion which substantially intersects with the outer side surface of the door.

The connection member may further include a bending portion which is bent from the planar portion to substantially intersect with the outer side surface of the door.

The connection member may include a recess formed by being recessed from the planar portion.

The connection member may include at least one through hole formed on the planar portion such that the thermal insulator is filled through the through hole.

The features of the above-mentioned embodiments are complexly applicable in connection with other embodiments unless these embodiments contradict each other.

Advantageous Effects of Invention

Effects of a refrigerator according to embodiments of the present invention are as follows.

In accordance with an embodiment of the present invention, the refrigerator is provided with only one door in order to open and close a storage region and an auxiliary storage region. Accordingly, the refrigerator may reduce a loss of cold air and need not install a heater for prevention of dew formation, compared to a case having two doors. Thus, it may be possible to prevent an increase in power consumption.

In accordance with an embodiment of the present invention, since the auxiliary storage region is installed to be rotatable relative to the door instead of a cabinet, the auxiliary storage region may be received within a storage chamber of the cabinet by a simple structure.

In accordance with an embodiment of the present invention, a portion of a connection portion of a second hinge member of the auxiliary storage region may be movably provided in a second hinge member receiving portion arranged in the door, and the connection portion may have a shape of curvature capable of bypassing a door gasket. Accordingly, it may be possible to form desired rotation trajectories of the door and container while the second hinge member does not pass through the gasket. Since the second hinge member is installable so as not to interfere with the gasket, it may be possible to avoid deterioration of cold air leakage prevention performance by sufficiently performing a function of the gasket.

In accordance with an embodiment of the present invention, since the second hinge member may have a small length in a forward and backward direction thereof, it may be possible to minimize deterioration of thermal insulation performance of the door while the door dose not have a thicker thickness.

In accordance with an embodiment of the present invention, it may be possible to effectively prevent deflection of a container by loads of the container and weight of food stored therein and deflection of the container by deformation and decoupling of a second hinge shaft of the second hinge member.

In accordance with an embodiment of the present invention, it may be possible to effectively prevent a problem caused due to linear misalignment between a first hinge shaft of a first hinge member and a second hinge shaft of a second hinge member. Particularly, it may be possible to effectively prevent poor rotation of the door caused by such linear misalignment.

In accordance with an embodiment of the present invention, when a user opens only the refrigerator door and has access to a front surface of the auxiliary storage region (container), the auxiliary storage region may be maintained in a state of being received inside the cabinet without being opened along with the refrigerator door. Thus, it may be possible to realize a usage form in which the container rotates independently of each of the cabinet and the door.

In accordance with an embodiment of the present invention, it may be possible to realize a usage form of the refrigerator in which the container may be additionally opened or closed in an opened state of only the door. In addition, it may be possible to realize a usage form of the refrigerator in which only the container is closed and the door is individually closed in an independently opened state of the door and the container and a usage form of the refrigerator in which the container and the door are closed together by closing only the door.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 19 is a view for explaining thermal insulation performance in an uninstalled state of the reinforced thermal insulator;

FIG. 20 is a table for explanation of FIG. 19;

FIG. 21 is a view for explaining thermal insulation performance in an installed state of the reinforced thermal insulator;

FIG. 22 is a table for explanation of FIG. 21;

BEST MODE FOR CARRYING OUT THE INVENTION

Reference will now be made in detail to the preferred embodiments of the present invention, examples of which are illustrated in the accompanying drawings. For convenience of description, a bottom freezer type refrigerator will be exemplified below as preferred embodiments of a refrigerator according to the present invention. Of course, the present invention is not limited to the bottom freezer type refrigerator, and is applicable to a top mount type refrigerator, a side by side type refrigerator, etc.

Figure 1:
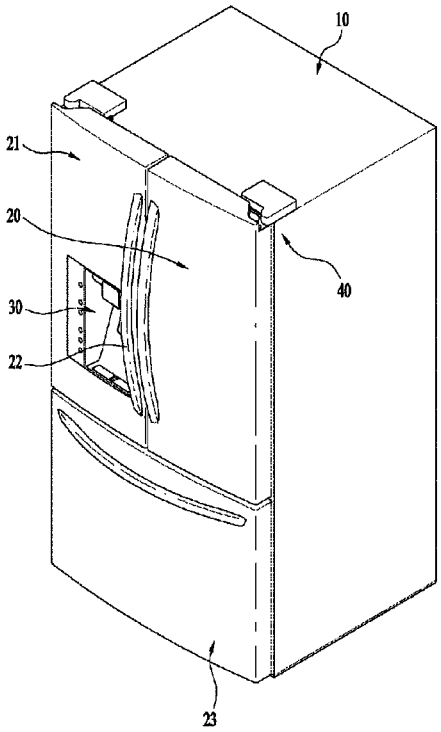
FIG. 1 is a perspective view illustrating an embodiment of a refrigerator according to the present invention.

First, an entire configuration of the preferable embodiment of the refrigerator according to the present invention will be described with reference to FIG. 1.

An upper portion of a cabinet 10 may be provided with a refrigerating chamber and a lower portion thereof may be provided with a freezing chamber. The upper portion of the cabinet 10 is installed with doors 20 and 21 such that the doors are rotatable by each hinge member 40 (hereinafter, referred to as "a first hinge member" for convenience), for opening and closing the refrigerating chamber. Although the present embodiment shows two doors 20 and 21 for opening and closing the refrigerating chamber, the present invention is not limited thereto. For example, the present embodiment may also use one door.

Each of the doors 20 and 21 is provided with a handle portion 22 for rotating each door 20 or 21. A user typically opens and closes the door by applying force in a state of gripping the handle portion 22. Accordingly, the handle portion 22 is preferably provided at a side opposite to the first hinge member 40. This enables securing of a large moment distance on the basis of the first hinge member 40. The handle portion 22 may be provided with a structure such as a button capable of being pressed by the user. The button may be interlocked with a latch to be described later so that the user may open only the door 21 of the refrigerator or open the door 21 together with a container by pressing the button.

Of course, the shape or structure of the handle portion 22 is not limited to that shown in the drawing, and the handle portion 22 may selectively have various structures.

One side of the door 21 may be provided with a dispenser 30 through which the user may be supplied with water or ice. The lower portion of the cabinet 10 may be installed with another door 23 for opening and closing the freezing chamber. The door 23 may be a drawer type door.

The refrigerator according to the present embodiment will be described in more detail with reference to FIG. 2. As described above, the present embodiment may have a first storage region 2 (e.g., a refrigerating chamber) at the upper portion of the cabinet 10. The present embodiment will be mainly described with respect to the first storage region 2 as a refrigerating chamber for convenience of description. However, since the principle of the present embodiment is not limited to a refrigerating chamber but is applicable to other storage regions such as the freezing chamber capable of storing food, a term "a first storage region" will be used below instead of an expression of the refrigerating chamber.

The refrigerator according to the present embodiment includes a container 100 defining another storage region (hereinafter, referred to as "a second storage region" for convenience) different from the first storage region 2. The container 100 is rotatable relative to the door 20 and is provided independently of the cabinet 10 and the door 20. That is, the container 100 may be rotated independently of the cabinet 10. The container 100 may be rotated independently of the door 20. For example, only the container 100 may be rotated in an opened state of the door 20. Accordingly, the first storage region may be changed to an opened state by rotating only the container 100, in a state shown in FIG. 2, namely in an opened state of the second storage region.

Although the present embodiment describes that the pair of doors 20 and 21 are provided and the container 100 is installed to the right door 20, the present invention is not limited thereto.

The relation and structure between the cabinet 10, the door 20, and the container 100 will be described in more detail with reference to FIG. 2. FIG. 2 shows an opened state of only the door 20 in a state in which the container 100 is received in the cabinet 10. That is, the user may have access to the container 100 by opening only the door 20, and FIG. 2 shows such a state.

The door 20 is rotatably coupled to the cabinet 10 through the first hinge member 40 such that the door 20 is rotatable relative to the cabinet 10. The first hinge member 40 is located at one side of the cabinet 10. The door 20 is rotatable about a rotary shaft 42 (hereinafter, referred to as "a first rotary shaft" for convenience) of the first hinge member 40 and may open and close the first storage region 2.

A gasket 26 is provided inside the door 20. The gasket 26 is arranged along an edge of the door 20. It is preferable that the gasket 26 generally has a square band shape along a square shape of the door 20. When the door 20 is rotated toward the cabinet 10 and closes the first storage region 2, the gasket 26 comes into contact with a front surface portion 12 of the cabinet 10, thereby preventing cold air from leaking from the first storage region 2. Accordingly, a connection relation between the door 20 and the cabinet 10 may be equal or similar to that in a typical refrigerator. A sealing boundary may be formed by the gasket 26. That is, the gasket 26 may form the sealing boundary in a closed state of the door 20. Consequently, cold air does not communicate between the inside and the outside of the sealing boundary.

In accordance with the present embodiment, the container 100 is rotatably coupled to the door 20 by second hinge members 200. A rotary shaft 206 (hereinafter, referred to as "a second rotary shaft" for convenience) of each of the second hinge members 200 may be located at the door 20. The second rotary shaft 206 may be a rotary shaft provided regardless of the first rotary shaft 42 of the first hinge member 40. That is, it is preferable that the first hinge member 40 is provided between the cabinet 10 and the door 20 and the second hinge member 200 is provided between the door 20 and the container 100.

In another aspect, the first hinge member 40 may be located outside the sealing region or sealing boundary defined by the gasket 26 and the second hinge member 200 may be located inside the sealing region or sealing boundary. Accordingly, since the container 100 is rotatable relative to the door 20 by the second hinge member 200, the container 100 may be received in the first storage region 2 of the cabinet 10. When the door 20 is closed by the first hinge member 40, the first storage region 2 and the container 100 are simultaneously sealed by one gasket 26 provided in the door 20.

Meanwhile, the second rotary shaft 206 of the second hinge member 200 may be provided at a predetermined position within the door 20. If the second rotary shaft 206 does not have the same axis S as the first rotary shaft 42, the container 100 may be rotated by a predetermined angle even when only the door 20 is intended to be opened. Thus, it is preferable that substantially the second rotary shaft 206 is vertically and linearly aligned with or has the same axis as the first rotary shaft 42. An enlarged portion in FIG. 2 schematically shows an interrelation between the first rotary shaft and the second rotary shaft. As will be described later, the shape of the second rotary shaft or the connection relation between the second rotary shaft and the door 20 may differ from that shown in the drawings.

Although the present embodiment shows and describes an example in which the first rotary shaft 42 and the second rotary shaft 206 are configured independently of each other, the present invention is not limited thereto. For example, the first rotary shaft 42 and the second rotary shaft 206 may also be connected physically and integrally to each other so as to be configured of one shaft. However, the rotary shafts of the first and second hinge members 40 and 200 are basically different configurations regardless of having the same axis or different axis. Accordingly, both may be rotatably provided independently of each other.

Hereinafter, the relation and structure between the cabinet 10, the door 20, and the container 100 will be described in more detail. For convenience of description, terms "an upward and downward direction", "a left and right direction", and "a forward and backward direction" will be used as shown in FIG. 2.

It is preferable that a size of the container 100 (a length (width) in the left and right direction and a length (height) in the upward and downward direction) is substantially provided so as not to be at least greater than that of the first storage region 2 so that the container 100 is received in the first storage region 2. That is, the size of the container 100 is preferably determined such that the container 100 may easily enter and exit the front of the first storage region 2.

In addition, the door 20 is provided to open and close the first storage region 2. Accordingly, the door 20 has a size greater than the container 100. That is, the second storage region defined by the container 100 may be automatically closed by closing the first storage region 2 by the door.

For convenience, assuming the first storage region 2, the container 100, and the door 20 have a circular shape, the door 20 has the largest radius and the container 100 has the smallest radius. Accordingly, assuming the components have a square shape, the door 20 may have the largest width and height and the container 100 may have the smallest width and height.

It is preferable that a depth (length in the forward and backward direction) of the container 100 occupies a predetermined portion of a depth (length in the forward and backward direction) of the first storage region 2.

Such a configuration allows the container 100 to be located in the first storage region 2 when the door 20 is closed. Accordingly, cold air in the first storage region 2 may be introduced into the second storage region through a communication port 121 (see FIG. 3).

There is a possibility that cold air leaks only between the front surface portion 12 of the cabinet 10 and an inside edge portion of the door 20. That is, there is a possibility that cold air in the first storage region 2 and cold air in the second storage region leak through the above portion. However, as described above, only one gasket 26 may be installed to the inside edge portion of the door due to the size and position between the container 100 and the door 20. That is, a region defined by one gasket 26 includes a region defined by the container, thereby enabling a leakage of cold air to be prevented.

Accordingly, according to the present embodiment, only the gasket 26 for the door 20 is provided without provision of a separate gasket for the container 100. Accordingly, according to the present embodiment, it may be possible to prevent a loss of cold air caused due to installation of a plurality of gaskets. In addition, a temperature difference between the inside and outside of the refrigerator is generated only at the installed portion of the gasket. Therefore, even when heaters are installed for heating, installation portions of the heaters are reduced. Consequently, the refrigerator may have a simple structure and effectively prevent a waste of energy.

The size and region of the above-mentioned door 20, container 100, and first storage region 2, and the region defined by the gasket may be based on those projected on the same plane in a closed state of the door. That is, when the refrigerator is projected on a vertical plane in the closed state of the door, the refrigerator has an area which is gradually increased in order from the container 100 to the first storage region 2, the gasket 26, and the door 20. Of course, the large area includes all of the small areas. Meanwhile, when one first storage region 2 is opened and closed by two doors (see FIG. 4), the above-mentioned relation between the size and the region may be satisfied at the respective left and the right on the basis of a pillar 62.

Meanwhile, the door 20 is preferably equipped with a latch 600 which may selectively couple the container 100 to the door 20. That is, when the door 20 and the container 100 are opened together, the container 100 is coupled to the door 20 by the latch 600. When only the door 20 is opened, the latch 600 decouples the container 100 from the door 20. For coupling and decoupling between the door 20 and the container 100 by the latch 600, the handle portion 22 is preferably provided with an operation portion (button). Accordingly, the latch 600 has a configuration in which force applied to the door by the user for opening of the door is selectively transferred to the container 100. That is, when the force is transferred to the container 100 through the latch, the container 100 may be opened together with the door. When the force is not transferred to the container 100 through the latch, only the door may be opened without opening of the container 100.

For example, when the user opens the door by gripping the handle portion 22 while pressing the operation portion, the container 100 is decoupled from the door 20 through the latch 600. In this case, only the door 20 is opened. On the other hand, when the user opens the door by gripping the handle portion 22 without pressing the operation portion, the coupling between the door 20 and the container 100 is maintained by the latch 600. In this case, the door 20 and the container 100 are opened together. It is because the second hinge member 200 connecting the door 20 to the container 100 is simultaneously rotated together with the door when the door 20 is coupled to the container 100.

The latch 600 may use a well-known structure. Accordingly, since the latch is not the main gist of the present embodiment, no detailed description will be given thereof.

Meanwhile, a storage portion 24 for storing food may also be provided on an inner side of the door 20. That is, after the user opens only the door 20 as shown in FIG. 2, the user may approach the storage portion 24 so as to store food in the storage portion 24 installed to the inner side of the door 20 or to take the stored food out of the storage portion. Of course, the container 100 may also use a space occupied by the storage portion 24 of the door 20, in such a way that the container has a deeper depth instead of providing the storage portion 24 of the door 20.

Next, it will be described that the door 20 and the container 100 are opened together with reference to FIG. 3.

In a case in which the user intends to use the first storage region 2, when the door 20 and the container 100 are opened together, the first storage region 2 enters a state of being accessible to the user. The first storage region 2 may have the substantial same structure as the storage chamber of the typical refrigerator. For example, the first storage region 2 may be provided therein with a plurality of shelves 4 and a drawer 6. The drawer 6 may be formed therein with a space for storing food, and the user may take food out of the drawer 6 by withdrawing the drawer 6. Accordingly, the drawer 6 is preferably withdrawn outward of the first storage region 2.

Meanwhile, the container 100 is preferably provided with a fixing device 500 which selectively couples the container 100 to the cabinet 10. That is, the fixing device 500 serves to couple the container 100 to the cabinet 10 when only the door 20 is opened. The fixing device 500 serves to decouple the container 100 from the cabinet 10 when the door 20 and the container 100 are opened together.

The fixing device 500 is provided at an upper portion of the container 100. The fixing device 500 is located in the rear of the door handle portion 22. Accordingly, the fixing device 500 is located to face the first and second hinge members 40 and 200.

When the container 100 is fixed to the cabinet 10 by the fixing device 500, only the door 20 may be opened. On the other hand, when the container 100 is not fixed to the cabinet 10, the door 20 and the container 100 may be opened together.

The fixing device 500 may be provided such that the fixing device 500 is decoupled from the cabinet 10 by applying a predetermined force. Similarly, the fixing device 500 may be provided such that, in the decoupled state of the fixing device 500 and the cabinet 10, the fixing device 500 is coupled to the cabinet 10 by applying a predetermined force.

When the decoupling between the door 20 and the container 100 is generated by the latch, force is not transferred to the container 100 through the latch during opening of the door 20. Accordingly, force for decoupling between the fixing device 500 and the cabinet 10 is not transferred. Therefore, in this case, only the door 20 may be opened. On the other hand, when the container 100 is coupled to the door 20 by the latch, force is transferred to the container 100 through the latch 600 during opening of the door 20. Therefore, in this case, forces for opening of the door 20, for opening of the container 100, and for decoupling of the fixing device have to be applied. When the forces are applied, the door 20 and the container 100 may be opened together.

Meanwhile, the fixing device 500 may have a configuration that the container 100 is additionally supported by the cabinet 10 in a state in which the container 100 is received in the first storage region 2. As shown in FIG. 3, the fixing device 500 is preferably located at a side opposite to the first hinge member 40, namely at a side opposite to the second hinge member 200 and the upper portion of the container 100. Consequently, the second hinge member 200 and the fixing device 500 may support the container at the left and the right of the container 100. However, the above-mentioned fixing device 500 may be an additional configuration.

Meanwhile, as described later, force for continuously opening the door may be applied at a maximum opening angle of the door relative to the container. In this case, even when the force for continuously opening the door is applied, the fixing device 500 may maintain a state in which the container is received within the cabinet.

Since the fixing device 500 is not the main gist of the present embodiment, no detailed description will be given thereof.

Figure 2:
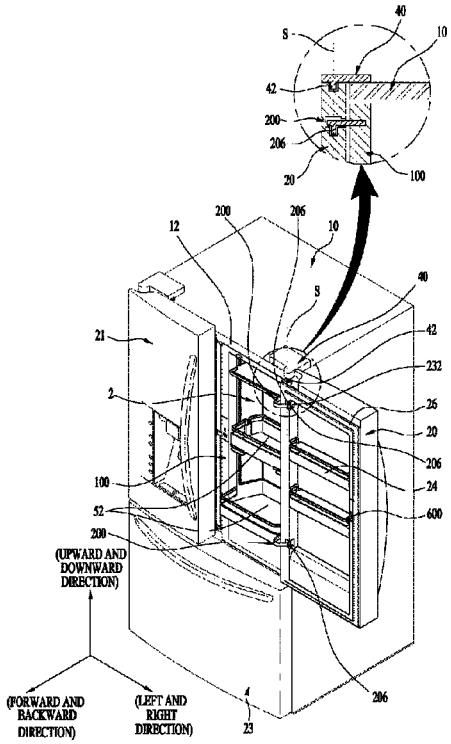
FIG. 2 is a perspective view illustrating an opened state of only a door in the refrigerator of FIG. 1.
Figure 3:
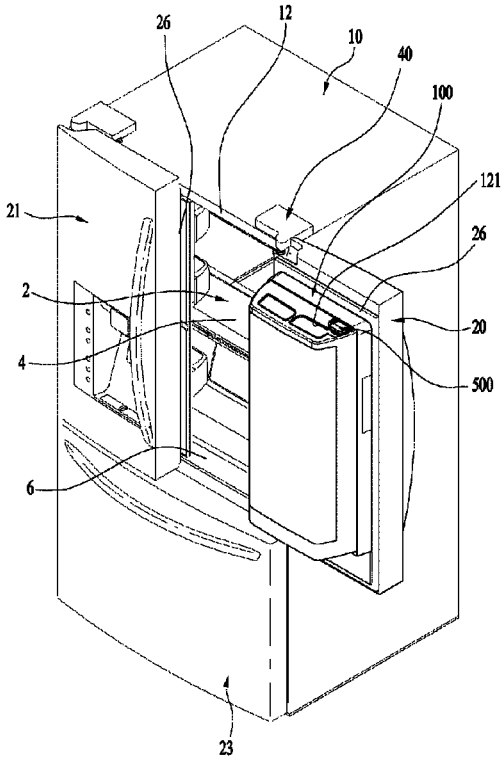
FIG. 3 is a perspective view illustrating an opened state of a door and a container in the refrigerator of FIG. 1.

Meanwhile, the present embodiment may realize a form shown in FIGS. 2 and 3 and a form in which the container 100 is opened and closed in an opened state of the door 20. It is because the container 100 is rotatably coupled to the door 20 by the second hinge member 200.

Figure 4:
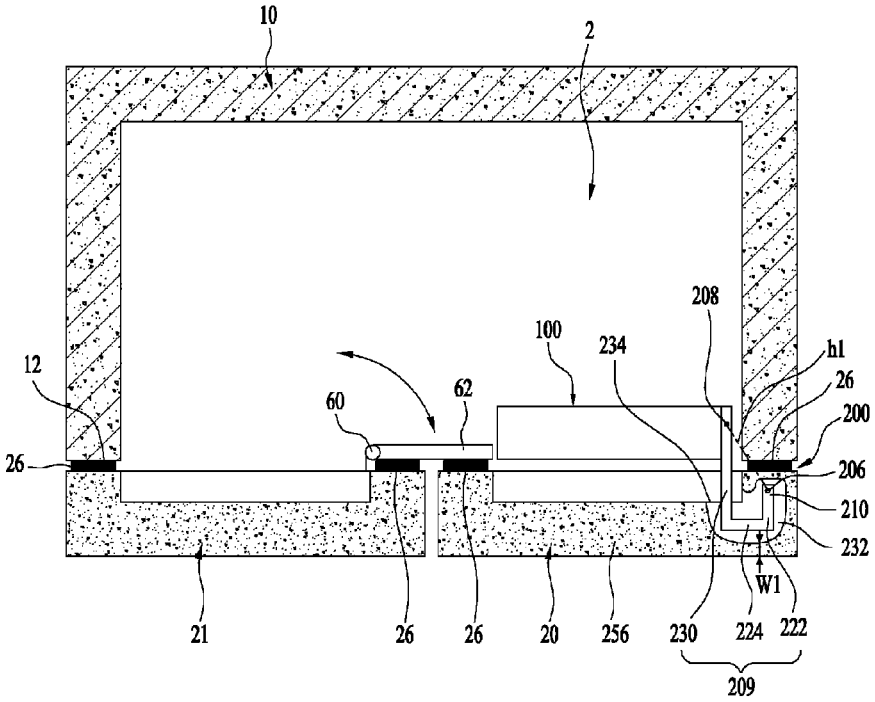
FIG. 4 is a view illustrating a closed state of the door in the embodiment of the present invention.
Figure 5:
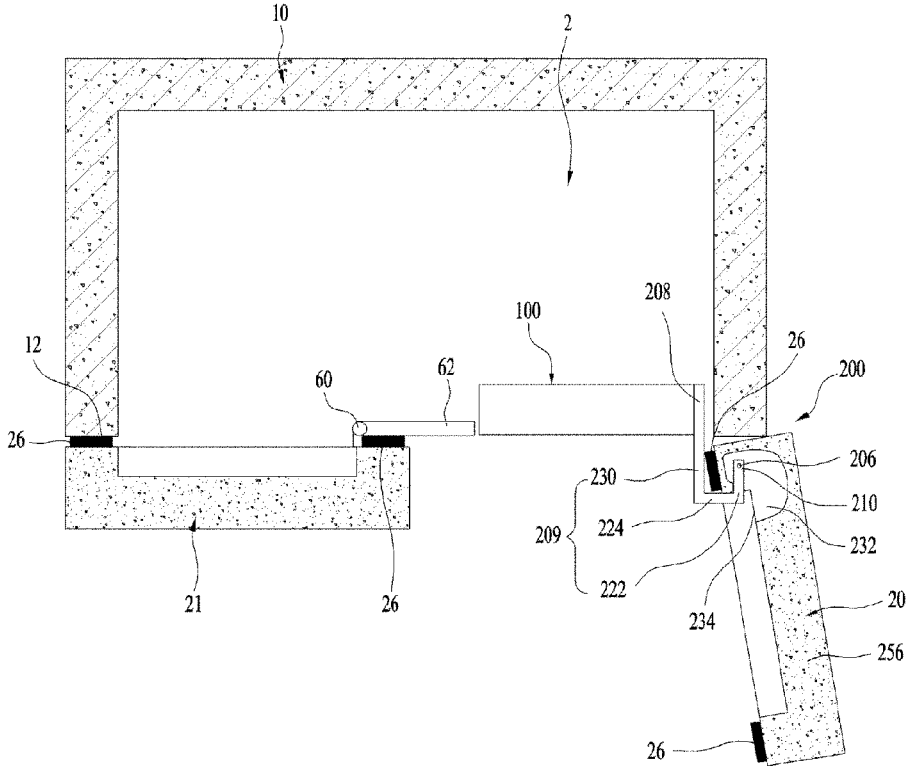
FIG. 5 is a view illustrating an opened state of only the door in the embodiment of the present invention.

Next, the second hinge member 200 will be described in more detail with reference to FIGS. 4 and 5. FIG. 4 shows a closed state of the door and FIG. 5 shows an opened state of only the door.

The first storage region 2 is provided in the cabinet 10. That is, the cabinet 10 defines a space for storing food, namely the first storage region 2. The cabinet 10 is connected with the doors 20 and 21 which may open and close the first storage region 2. Although FIGS. 4 and 5 show two doors 20 and 21, the present embodiment is not limited thereto. For example, one door may also be applied to the embodiment.

When two doors 20 and 21 are applied for opening and closing the first storage region 1, one of the two doors 20 and 21, for example one end of the left door 21 may be equipped with a pillar 62. Consequently, the pillar 62 serves to cover a clearance generated between the two doors 20 and 21. The pillar 62 rotates about a center of rotation 60. That is, when the left door 21 is opened, the pillar 62, the pillar 62 is substantially perpendicular to the left door 21 while rotating inward of the left door 21 (in a counterclockwise direction on the drawing). Therefore, since the pillar 62 does not disturb rotation of the left door 21, the left door 21 is opened. When the left door 21 is closed, the pillar 62 is substantially parallel with the left door 21 while rotating outward of the left door 21 (in a clockwise direction on the drawing). Therefore, the pillar 62 comes into contact with the cabinet 10 (a state shown in FIG. 4). The right door 20 is opened and closed regardless of the pillar 62. Since the pillar 62 is a well-known structure and is not the main gist of the present embodiment, no detailed description will be given thereof.

The second hinge member 200 according to the present embodiment will be described in more detail. When the two doors 20 and 21 are installed to the cabinet 10, the containers and the second hinge members 200 may be provided at the left and the right, respectively. However, hereinafter, for convenience of description, it is exemplified that the container 100 is installed only to the right door 20.

As describe above, the container 100 is rotatably connected to the door 20 by the second hinge member 200. Since the container 100 has a shape capable of being received in the first storage region 2, contact between the cabinet 10 and the door 20 is generated only at the front surface portion 12 of the cabinet 10. Accordingly, the gasket 26 may be provided only on the inside edge of the door 20. That is, when the door 20 is closed, the gasket 26 comes into contact with the front surface portion 12 of the cabinet 10 and the front surface portion of the pillar 62, thereby preventing cold air in the first storage region 2 and the container 100 from leaking to the outside.

Meanwhile, the second hinge member 200 serves to rotatably connect the container 100 to the door 20 and to support the container 100. That is, a center of rotation of the container 100, namely the second rotary shaft 206 is located at the door 20. The second hinge member 200 includes a rotation portion 210 which is rotatable about the second rotary shaft 206 and a fixed portion 208 fixed to the container 100. It is preferable that the second hinge member 200 further includes a connection portion 209 connecting the rotation portion 210 and the fixed portion 208.

The second rotary shaft 206 or the rotation portion 210 may be provided at a predetermined position within the door 20. As described above, if the second rotary shaft 206 does not have the same axis as the first rotary shaft (see the rotary shaft 42 of the first hinge member 40 in FIG. 2), the container 100 may be rotated by a predetermined angle even when only the door 20 is intended to be opened. Thus, it is preferable that substantially the second rotary shaft 206 is vertically and linearly aligned with or has the same axis as the first rotary shaft 42 (see FIG. 2).

Meanwhile, the second hinge member 200 may have various shapes. For example, the connection portion 209 of the second hinge member 200 may have a shape h1 (indicated by a hidden line in FIG. 4) corresponding to a linear distance connecting the fixed portion 208 and the rotation portion 210. However, since such a shape affects radii of rotation of the door 20 and the container 100, the second hinge member 200 has to pass through the gasket 26 attached to the door 20. Accordingly, it is preferable to determine a shape of the second hinge member 200 such that the second hinge member 200 forms smooth rotation trajectories of the door 20 and the container 100 without passing through the gasket 26.

To this end, in the embodiment of the present invention, a length of the connection portion 209 of the second hinge member 200 is preferably longer than the linear length h1 between the fixed portion 208 and the rotation portion 210. That is, the connection portion 209 is preferably formed to have a bypass path longer than the shortest linear length h1 between the fixed portion 208 and the rotation portion 210. For example, at least a portion of the connection portion 209 may be curved. For another example, at least a portion of the connection portion 209 may have a bent shape. That is, the connection portion 209 is preferably formed to have a path bypassing the gasket 26. Such a bypass path is preferably formed from the rotation portion 210 provided within the door to the fixed portion 208 connected to the container 100 received in the first storage region 2 by bypassing the gasket 26. In other words, the connection portion 209 preferably extends from the rotation portion 210 to the fixed portion 208 by being bypassed into the sealing boundary.

The preferable embodiment of the second hinge member 200 according to the present invention will be described. The second hinge member 200 preferably includes a first extension portion 222 extending forward of the door from the rotation portion 210, and a second extension portion 230 backwardly extending from the first extension portion 222 to the fixed portion 208. Due to such a shape of the second hinge member 200, an opening angle of the door 20 may be increased in a state in which the container 100 is located in the first storage region 2. In addition, since the second hinge member 200 has a shape enclosing the gasket 26, interference with the gasket 26 may be prevented. Thus, it may be possible to avoid deterioration of cold air leakage prevention performance by sufficiently performing a function of the gasket.

A third extension portion 224 is preferably provided between the first and second extension portions 222 and 230. The third extension portion 224 is preferably in parallel with the front surface of the door 20. When the third extension portion 224 is provided, it may be possible to obtain a desired length of the connection portion 209 by the third extension portion 224 while the length of the first extension portion 222 is reduced. That is, when the third extension portion 224 is provided, it may be possible to obtain a desired maximum opening angle of the door (a maximum opening angle of the door 20 in a state in which the container 100 is located in the first storage region 2) while the size of the first extension portion 222 is reduced. Here, it is advantageous to maintain thermal insulation performance of the door as the length of the first extension portion 222 becomes shorter. In this case, since a depth (a length of the door in a thickness direction thereof) of a receiving portion 232, particularly a receiving space is increased as the length of the first extension portion 222 becomes longer, a thermal insulator 256 of the door 20 has a decreased thickness W1. Consequently, it is difficult to obtain a desired thermal insulation performance. However, when the length of first extension portion 222 is decreased, the thickness W1 of the thermal insulator 256 of the door 20 is increased. Therefore, it may be possible to obtain a desired thermal insulation performance. In addition, it may be possible to effectively prevent interference between the second hinge member 200 and the gasket 26 by the third extension portion 224.

As described above, since a portion of the second hinge member 200 is located within the door 20, the receiving portion 232 having a predetermined space for receiving a portion of the second hinge member 200 is preferably provided in a predetermined position of the door 20. This may refer to a second hinge member receiving portion 232. That is, the receiving portion 232 is provided in the door 20, and a portion of the second hinge member 200 is located in the receiving portion 232. In addition, the receiving portion 232 has an opening portion 234 through which a portion of the second hinge member 200 passes, and at least the rotation portion 210 of the second hinge member 200 is rotatably connected to the door 20 through the opening portion 234.

As shown in FIG. 4, in a closed state of the door 20, the opening portion 234 is provided inside a region sealed by the gasket 26, namely the sealing boundary. The receiving portion 232 may extend from the opening portion 234 to the outside of the region sealed by the gasket 26 within the door 20. Accordingly, the second hinge member 200 which rotates in the receiving portion 232 and the opening portion 234 may not interfere with the gasket 26.

The more preferable embodiment of the second hinge member 200 will be described with reference to FIGS. 6 and 7. As described above, the second hinge member 200 is preferably determined considering radii of rotation of the door 20 and the container 100, prevention of interference with the gasket 26, etc. Furthermore, the second hinge member 200 is preferably determined considering thermal insulation performance of the door 20. In order to maximally obtain an opening degree of the door 20, the second hinge member 200 requires a large rotation trajectory and the door 20 has to have a thicker thickness corresponding to the same. However, since it is difficult to increase the thickness of the door 20, the thermal insulation performance of the door 20 may be deteriorated. Therefore, the door 20 has to have a sufficient rotation trajectory and a basic insulation thickness while the entire length of the second hinge member 200 is reduced. Hereinafter, a preferable shape of the second hinge member 200 for having such a structure will be described.

The first extension portion 222 of the second hinge member 200 may extend forward of the door 20 while having a predetermined inclination toward the inner side of the door 20 or in a direction of the second extension portion 230. That is, it is preferable that the first extension portion 222 forwardly extends while being inclined by a predetermined angle instead of being vertical. By such a configuration, the length of the first extension portion 222 in the forward and backward direction thereof may be decreased while entirely having the same length. Thus, it may be possible to obtain a large clearance W1 between the receiving portion 232 and the front surface of the door 20 and to minimize deterioration of the thermal insulation performance since the thermal insulator 256 may be foamed in a portion of the relatively large clearance W1. Moreover, when the first extension portion 222 is inclined, it may be possible to obtain a large clearance W2 between the receiving portion 232 and the side surface of the door 20 and to minimize deterioration of the thermal insulation performance since the thermal insulator 256 may be foamed in a portion of the relatively large clearance W2. In other words, it may be possible to reduce deterioration of the thermal insulation performance since a space filled with the thermal insulator 256 may be increased in proportion to a reduction of the receiving space by the receiving portion 232.

Meanwhile, the second extension portion 230 preferably has a curved portion 230*a*. For example, the second extension portion 230 may be curved while having a predetermined curvature. That is, it is preferable that the second extension portion 230 does not extend to be vertical toward the rear of the cabinet 10 but has a predetermined curvature or a varied curvature. It is because the second extension portion 230 is close to the gasket 26 and interferes with the gasket 26 as the door 20 is gradually opened (see FIG. 5). Thus, the second extension portion 230 preferably has a shape corresponding to the trajectory of the gasket 26. In connection with the trajectory GT (indicated by an alternate long and short dash line in FIG. 6) of the gasket 26 when the door 20 rotates, the second extension portion 230 is preferably curved to correspond to the outermost trajectory of the gasket 26 and have a trajectory greater than the outermost trajectory. For example, it is preferable that the second extension portion 230 is curved in a central direction of the refrigerator and the door 20 does not interfere with the gasket 26 during rotation of the door 20.

Figure 6:
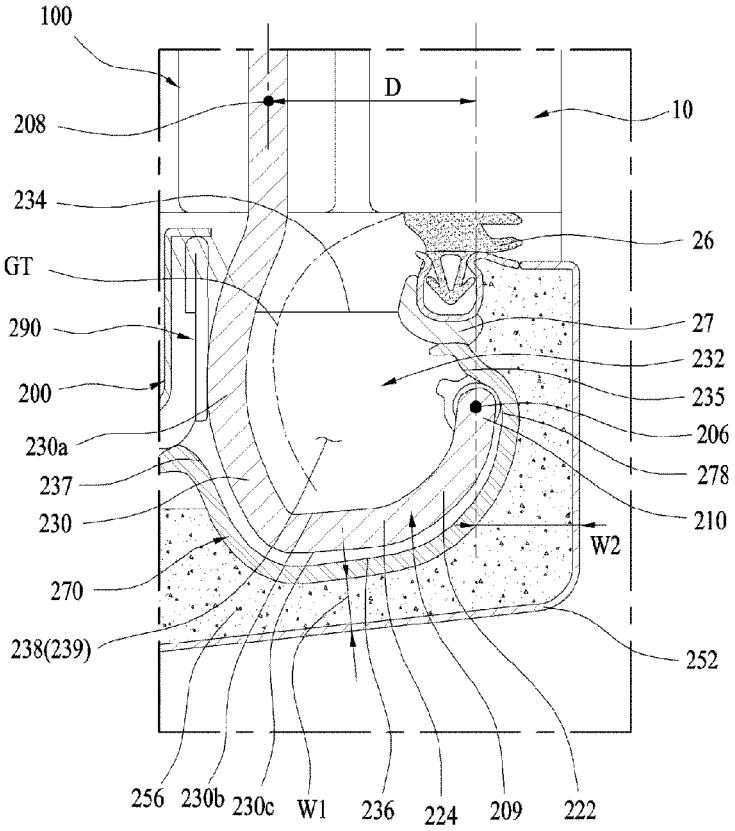
FIG. 6 is a cross-sectional view illustrating an embodiment of a second hinge member, and shows a closed state of the door.

A clearance between the first extension portion 222 and the second extension portion 230 may be determined corresponding to a clearance D between the fixed portion 208 and the rotation portion 210 in a direction perpendicular to the left and right direction (see FIG. 6). For example, a predetermined portion of the clearance between the first extension portion 222 and the second extension portion 230 may be larger than the minimum clearance D between the fixed portion 208 and the rotation portion 210 in the left and right direction.

Meanwhile, the shape of the second hinge member 200 is preferably determined in connection with an opening angle of the door 20. A description thereof will be given.

It is preferable that before the door 20 is maximally opened, the second hinge member 200 does not come into contact with one side of the opening portion 234 of the receiving portion 232. It is because, if the second hinge member 200 comes into contact with one side of the opening portion 234 of the receiving portion 232 before the door 20 is maximally opened, the container 100 may be opened along with the door 20 even when the user intends to open only the door 20. In addition, it is because force applied for rotation of the door may be transferred to the container 100 through the second hinge member 200 coming into contact with the opening portion 234. That is, it is because the opening portion 234 may come into contact with the second hinge member 200 to rotate the second hinge member 200 and thus the container 100 may be rotated by rotation of the second hinge member 200.

In order for the second hinge member 200 to do not come into contact with one side of the opening portion 234 of the receiving portion 232 when the door 20 is opened, the length of the second hinge member 200 in the forward and backward direction thereof, for example the length of the first extension portion 222 is elongated. However, in this case, since the clearance W1 between the receiving portion 232 and the outer surface of the door 20 is decreased, it may be possible to deteriorate thermal insulation performance. Therefore, there is a problem in that the door 20 has a thickness thicker than the existing thickness. Accordingly, it is preferable that when the door 20 is maximally opened, the second hinge member 200 substantially comes into contact with one side of the opening portion 234. That is, the second hinge member 200 may be configured to come into contact with one side of the opening portion 234 when the door 20 is maximally opened.

Distances from the rotation portion 210 of the second hinge member 200 to the second extension portion 230 in the central direction of the door are preferably formed to differ from each other within a range extending from the fixed portion 208 of the second extension portion 230 to the third extension portion 224. This may be realized by the curved portion of the second extension portion 230.

In addition, a forward and backward distance of the second extension portion 230 from the fixed portion 208 to the rotation portion 210, namely a distance in an outer side surface direction of the door is preferably smaller than a distance from the fixed portion 208 of the second extension portion 230 to a portion formed by being bent and extending to the third extension portion 224.

In more detail, the second hinge member receiving portion 232 include the opening portion 234. The opening portion 234 is formed by being recessed from the inner side surface of the door to the outer side surface thereof within the sealing boundary. That is, the opening portion 234 is provided on the front surface of the second hinge member receiving portion 232.

The second hinge member receiving portion 232 may include a first side wall portion 235, a rear wall portion 236, and a second side wall portion 237. In addition, the second hinge member receiving portion 232 may include an upper side wall portion 238 and a lower side wall portion 239.

The first side wall portion 235 may extend to enclose the gasket 26 from one side of the opening portion 234. For example, the first side wall portion 235 may be formed to enclose a portion of the gasket 26 in the rear of the gasket 26. The rear wall portion 236 may extend in a horizontal direction from the first side wall portion 235. The second side wall portion 237 may extend from the rear wall portion 236 to the other side of the opening portion 234. The upper and lower side wall portions 238 and 239 may be provided to respectively connect the first side wall portion 235, the rear wall portion 236, and the second side wall portion 237 at upper and lower portions. Consequently, the opening portion 234 may be formed.

A seating portion for seating of the rotation portion 210 of the second hinge member 200, for example, an axial hole 278 may be formed at a position adjacent to the first side wall portion 235. Accordingly, the second hinge member receiving portion 232 may receive a portion of the connection portion 209 of the second hinge member 200 during rotation of the second hinge member 200. In addition, the volume or length of the connection portion 209 received in the receiving portion 232 may be varied according to the angle between the door and the container 100.

Figure 7:
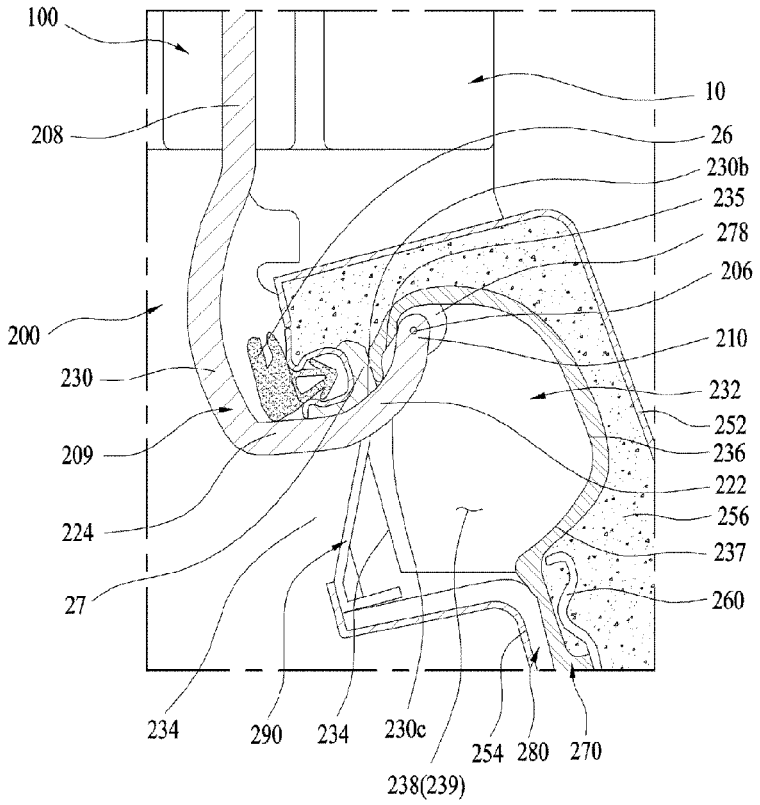
FIG. 7 is a cross-sectional view illustrating the embodiment of the second hinge member, and shows an opened state of the door.

As shown in FIGS. 6 and 7, when the door 20 is rotated relative to the container 100 (when the door is varied from a state shown in FIG. 6 to a state shown in FIG. 7), a portion of the connection portion 209 of the second hinge member 200 is away from the second side wall portion 237 to move in a direction adjacent to the first side wall portion 235. The container 100 may be maintained in a state of being received in the storage chamber until a portion of the connection portion 209 of the second hinge member 200 comes into contact with the first side wall portion 235. Thus, when the connection portion 209 of the second hinge member 200 comes into contact with the first side wall portion 235 of the receiving portion 232, it may be possible to form a maximum opening angle of the door relative to the container.

The connection portion 209 of the second hinge member 200 may include a first vertical surface 230*b* facing the gasket and a second vertical surface 230*c* facing the rear wall portion 236 or the second side wall portion 237 of the receiving portion 232. The first vertical surface 230*b* may be formed in a shape coming into surface contact with the first side wall portion 235. The second vertical surface 230*c* may be formed in a shape coming into surface contact with each of the second side wall portion 237 and/or the rear wall portion 236. While the first vertical surface is adjacent to the first side wall portion 235 at a position in which the second vertical surface 230*c* of the connection portion 209 is adjacent to the second side wall portion 237, the container 100 and the door 20 are rotatable independently of each other. Thus, when the first vertical surface 230*b* comes into contact with the first side wall portion 235, the opening angle of the door 20 relative to the container 100 may be maximized.

Due to the shape and position between the second hinge member 200 and the receiving portion 232, it may be possible to reduce an impact generated at both ends of a relatively angular range allowed between the door and the container and perform a smooth operation therebetween. It may be possible to increase an independently rotatable angular range between the door and the container.

Meanwhile, a clearance maintaining portion 27 may be provided at one side of the opening portion 234 of the receiving portion 232. The clearance maintaining portion 27 preferably encloses one side of the gasket 26. Accordingly, the first side wall portion 235 may include the clearance maintaining portion 27. When the opening angle of the door 20 is gradually increased to become a predetermine angle during opening of only the door 20, a portion of the second hinge member 200 comes into contact with the clearance maintaining portion 27 to restrict opening of the door 20. That is, the clearance maintaining portion 27 prevents the second hinge member 200 from coming into contact with the gasket 26 so as to prevent damage of the gasket. Of course, when a predetermined portion of the second hinge member 200 comes into contact with the clearance maintaining portion 27, it is preferable that the container 100 is still located in the first storage region 2.

As described above, it may be possible to determine a restriction angle by which the door 20 is maximally opened in a state in which the container 100 is received in the first storage region 2. For convenience, in the specification, the restriction angle is referred to as a maximum opening angle of the door 20 relative to the container 100. The maximum opening angle of the door 20 relative to the container 100 may mean an angle from an opening angle of the door, when a portion of the second hinge member 200 begins to come into contact with one side of the opening portion 234 of the receiving portion 232 of the door 20, to an opening angle of the door by which the container 100 protrudes to the front surface of the first storage region 2 of the cabinet 10 and is decoupled from the door by continuously applying force to the door 20 by the user. The maximum opening angle of the door 20 relative to the container 100 is preferably within a range of about 90° to 110°. In other words, the opening angle of the door (referred to as "a angle" for convenience) when one side of the opening portion 234 or the clearance maintaining portion 27 interferes with the second hinge member 200 may be the maximum opening angle. The opening angle of the door (referred to as "b angle" for convenience) immediately before the container 100 is decoupled from the first storage region 2 by further opening of the door after beginning of the interference may also be the maximum opening angle. Of course, the maximum opening angle may also be determined between the "a angle" and the "b angle". For example, due to elasticity of the clearance maintaining portion 27, the maximum opening angle of the door relative to the container may be varied within a range of elastic force.

When the door 20 is continuously opened at the maximum opening angle of the door 20 relative to the container 100, the container 100 is opened. Therefore, a separate locking device for locking the container 100 to the cabinet 10 may be provided such that the door 20 is not opened any longer. The clearance maintaining portion 27 may prevent direct contact between the gasket 26 and the door 20 even when a configuration such as the locking device for locking the cabinet 10 is not present, thereby preventing the gasket 26 and the door 20 from being damaged.

In addition, a stopper, configured so as not to open the door any longer when the opening angle of the door 20 becomes a predetermined angle during opening of only the door 20, namely when the opening angle of the door 20 becomes an angle at which the container begins to be opened, may be provided between the door 20 and the cabinet 10. That is, in order for the container 100 to be maintained in a state of being located in the first storage region 2, the stopper for restricting the opening angle of the door 20 as a restriction angle may also be provided by such a configuration, a portion of the second hinge member 200 does not come into contact with one side of the opening portion 234 of the receiving portion 232 of the door 20. Thus, it may be possible to prevent damage of the door 20 and the gasket 26 caused by excessive opening of the door by the user without a configuration such as the clearance maintaining portion 27.

Meanwhile, in the embodiment of the present invention, the container 100 and the door 20 may also be opened together without provision of the locking device or the stopper. Even in such a case, the maximum opening angle of the door relative to the container is maintained. In this case, the maximum opening angle of the door relative to the container differs from the maximum opening angle of the door relative to the cabinet. Accordingly, the user also has access to the second storage region in the rear of the container 100. As shown in FIGS. 6 and 7, the clearance maintaining portion 27 is preferably formed of an elastic member to be elastically deformable. That is, when the container 100 is received in the first storage region 2 and the opening angle of the door 20 reaches a maximum opening angle of the door 20 relative to the container 100 by opening of only the door 20, the clearance maintaining portion 27 comes into contact with the second hinge member 200. In this case, force applied to the door 20 causes elastic deformation of the clearance maintaining portion 27. Accordingly, a portion of the force applied by the user is absorbed by the clearance maintaining portion 27.

For this reason, in a case where only the door 20 is opened by applying a certain force, larger force for further opening of the door is required when reaching the maximum opening angle of the door relative to the container. Thus, it may be possible to prevent the container 100 from suddenly rotating by opening of the door. It is because the user may sense a size difference or a change of forces applied during opening of the door.

As described above, FIG. 2 shows an opened state of only the door and FIG. 3 shows a state in which the door and container are opened together. In this case, the opening angles of the door relative to the cabinet are similarly shown. However, unlike that shown in the drawings, it is preferable that an angle by which the door may be maximally opened differs from an angle by which the container and the door may be maximally opened together in a state in which the container is received in the first storage region 2. That is, the latter angle is preferably larger. It is because interference between the door and the second hinge member 200 may be prevented regardless of the opening angle when the door and the container are opened together.

In addition, the user has access to the second storage region in the opened state of only the door. However, the user has access to the first storage region in the state in which the door and the container are opened together. Accordingly, in the latter case, the drawer 6 within the first storage region need be forwardly withdrawn. In this case, it is necessary that the opening angle of the door is larger than the maximum opening angle of the door relative to the container. It is because generation of interference between the drawer 6 and the container 100 is prevented during withdrawal of the drawer 6. For example, the maximum angle by which the door and the container are opened together may be determined within a range of about 150°.

Next, the coupling structure between the door 20 and the second hinge member 200 will be described with reference to FIGS. 7 to 9. First, the basic coupling structure between the door 20 and the second hinge member 200 will be described with reference to FIG. 7.

The container 100 is coupled to the door 20 by the second hinge member 200 and food is stored in the container 100. Accordingly, the loads of the container 100 and the loads of food stored in the container 100 are applied to the second hinge member 200 itself and the coupling portion between the second hinge member 200 and the door 20. Therefore, by such loads, deflection of the container 100 may be generated or a portion for supporting the rotation portion 210 of the second hinge member 200 may be deformed. Of course, the second hinge member 200 itself may be deformed. As a result, the container 100 may not be properly seated in the first storage region 2. In addition, the center of rotation of the second hinge member 200 may not be linearly aligned with the second rotary shaft 206, and thus the container 100 may not be smoothly rotated. This is a critical problem which has to be necessarily solved in a structure in which the rotary shaft 206 of the container 100 is provided in the door 20 instead of being provided in the cabinet 10.

Particularly, similarly to the first rotary shaft 42 of the first hinge member 40, the rotary shaft 206 of the second hinge member 200 may be provided at each of the upper and lower portions of the door 20. That is, two second hinge members 200 may be provided in the door 20. In this case, the second hinge member 200 provided in the lower portion of the door has to endure the loads of the container 100. For this reason, the second hinge member 200 may be deformed and damaged and thus the container 100 may be deflected. These problems may be remarkably shown in the second hinge member 200 provided in the lower portion of the door.

To solve these problems, the present embodiment may include a connection support member 260 which distributes the loads of the container 100 to the door 20 through the first hinge member 40 or transfers the loads to the first hinge member 40. The connection support member 260 may transfer the loads to the first hinge member 40 located at the lower portion of the door. In addition, the connection support member 260 may be provided to prevent the rotary shaft of the second hinge member 200 from being distorted relative to the rotary shaft of the first hinge member 40. That is, when both rotary shafts have the same axis, the connection member may be provided to effectively maintain the same axis. In addition, when both rotary shafts have a predetermined angle and form different axes (for example, when both rotary shafts form different axes parallel with each other), the connection member may be provided to effectively maintain the determined angle without distortion thereof.

Specifically, the connection support member 260 may be provided to couple the first and second hinge members 40 and 200 to each other in order to prevent distortion of the rotary shaft 206 of the second hinge member 200 relative to the rotary shaft 42 of the first hinge member 40.

Through the connection support member 260, the rotary shaft 42 of the first hinge member 40 and the rotary shaft 206 of the second hinge member 200 may maintain the same axis located on the same line or may maintain different axes located on lines parallel with each other.

At least a portion of the connection support member 260 is preferably fixed within the door 20. That is, the connection support member 260 is separately provided from the panel defining an external appearance of the door 20 or the thermal insulator 256 provided within the door 20, and may be coupled to the panel within the door 20. Thus, the loads applied the second hinge member 200 may be distributed to the door or be transferred to the first hinge member 40.

The connection support member 260 may be structurally directly or indirectly connected with the first hinge member 40 or the second hinge member 200. For example, the first hinge member 40 or the second hinge member 200 may be coupled to the connection support member 260 through a mounting member 270 and a coupling member 268 to be described later. The mounting member 270 may be coupled to a bracket 280 to be described later. The bracket 280 may be coupled to the door panel within the door. The connection member according to the embodiment of the present invention will be described with reference to FIG. 8.

The connection support member 260 for coupling the first hinge member 40 to the second hinge member 200 is located between an inside panel 254 and an outside panel 252 of the door 20. At least a portion of the connection support member 260 is preferably fixed within the door 20.

Through the connection support member 260, after the first and second hinge members 40 and 200 are coupled to each other, foam for formation of a foam thermal insulator 256 may be performed within the door.

The connection support member 260 may vertically extend at one side within the door in order to be connected with the second hinge member 200 provided in each of the upper and lower portions of the door.

The connection support member 260 is preferably formed to have a predetermined rigidity. To this end, the connection support member 260 may be made of a metal material.

The connection support member 260 is substantially connected to any portion of the second hinge member 200. By foaming the thermal insulator 256 in a space between the inside panel 254 and the outside panel 252, the thermal insulator 256 and the connection support member 260 have bonding force to endure the loads of the container 100 and food (the preferable shape of the connection member will be described later). That is, the upper and lower portions of the connection support member 260 are respectively connected with the rotation portion 210 of the upper and lower second hinge members 200, so that the loads of the container 100 and the food stored in the container 100 are distributed to the door 20 through the connection support member 260 connected to the second hinge member 200. Consequently, the center of rotation of the second hinge member 200 may be maintained, and it may be possible to prevent deflection of the second hinge member 200. The connection support member 260 may also be connected to any one of the upper and lower second hinge members 200. Of course, the connection support member 260 may be respectively provided at the upper and lower portions. Consequently, the connection members may be individually connected to the second hinge members 200 provided at the respective upper and lower portions.

Meanwhile, the connection support member 260 may also be connected to a portion of the first hinge member 40 (see FIG. 3) as well as the second hinge member 200. The first hinge members 40 are respectively provided between the cabinet 10 and the door 20 in a state of being spaced from the upper and lower portions of the door by a predetermined distance. It may be possible to connect a portion for supporting the rotation portion of the upper first hinge member 40 and a portion for supporting the rotation portion of the upper second hinge member 200 and to connect the connected portion to the connection support member 260. The first hinge member 40 and the second hinge member 200 provided at the lower side or the lower portion of the door may be similarly applied. By such a configuration, the loads of the container 100 and the food stored in the container 100 may be transferred to the cabinet 10 through the second rotary shaft 206, the connection support member 260, and the first rotary shaft 42 so as to securely support the container 100 on the door 20. Consequently, it may be possible to prevent misalignment between the first and second rotary shafts 42 and 206.

Meanwhile, as described above, a portion of the second hinge member 200 may also be directly connected to the connection support member 260. However, it is preferable to use the mounting member 270 for the second hinge member 200 considering convenience of assembly. For example, the mounting member 270 may be connected to the connection support member 260 and the second hinge member 200 may be connected to the mounting member 270. The mounting member 270 preferably has a shape corresponding to the shape of the second hinge member 200 (the preferable shape of the mounting member will be described later).

Meanwhile, although the mounting member 270 may be connected to the connection support member 260 and the second hinge member 200 may be connected to the mounting member 270, the bracket 280 may also be used. For example, it is preferable that the inside panel 254 is sequentially connected with the bracket 280, the mounting member 270, and the connection support member 260 and then the thermal insulator 256 is foamed. By such a configuration, it may be possible to solve many problems caused by coupling the container 100 to the door 20. For example, it may be possible to effectively prevent deflection of the container 100 by the loads of the container 100 and the food stored therein, deflection of the container 100 by the deformation and decoupling of the second rotary shaft 206, unsmooth rotation of the door 20 caused by misalignment between the first rotary shaft and the second rotary shaft 206, etc.

The preferable structure of the door 20 and the embodiment of the connection support member 260 will be described in more detail with reference to FIG. 8.

Similarly to the typical door, the door 20 includes the inside panel 254 and the outside panel 252. Since the inside panel 254 and the outside panel 252 are well known, no detailed description will be given thereof.

In the embodiment, the connection support member 260 is located between the inside panel 254 and the outside panel 252. The shape and configuration of the connection support member 260 are not limited. That is, a plurality of connection support members 260 coupled to each other may also be realized.

The connection support member 260 may be formed in a shape vertically occupying a portion in which the second hinge member 200 is coupled to the door 20, for example a plate-shaped member having a predetermined width. In addition, the connection support member 260 may be formed with a plurality of through holes 260*d* so as to, considering pressure generated during foaming of the thermal insulator 256, distribute foam pressure of the thermal insulator 256 and increase a bonding area with the thermal insulator 256. The connection support member 260 is preferably made of a metal material having a predetermined rigidity. That is, the connection support member 260 may be directly or indirectly coupled to the second hinge member 200 within the door 20 so as to simultaneously support and distribute the loads of the container 100. Thus, the support member is preferably a plate-shaped member having a predetermined thickness so as to increase a bonding area with the thermal insulator 256 for load distribution and has sufficient rigidity against bending.

Specifically, the connection support member 260 is structurally directly or indirectly connected to the second hinge member 200 so as to be buried into the thermal insulator 256 within the door. That is, it is preferable that the second hinge member 200 may be securely supported on the door by generation of bonding force with the thermal insulator 256. In addition, it is preferable that the loads of the container transferred to the door through the second hinge member 200 are uniformly distributed to the door.

The connection support member 260 may include a planar portion 260*a*. The planar portion 260*a* may be substantially parallel with the front surface of the door. The connection support member 260 may include a bending portion 260*b* perpendicular to the planar portion 260*a*. The planar portion 260*a* and the bending portion 260*b* may be formed with the through holes 260*d*. The plural through holes 260*d* may be formed and the foamed thermal insulator 256 may be inserted through the through holes.

Each of the through holes 260*d* is formed in the form of a vertical slot. The through hole may increase bonding force for supporting moment applied to the first hinge member 40 and the second hinge member 200. Of course, the bending portion 260*b* may also be a planar portion. That is, the bending portion 260*b* may be a planar portion which substantially intersects with the front surface of the door.

Meanwhile, the planar portion 260*a* of the connection support member 260 may be formed with a recess in the forward and backward direction. Accordingly, the bonding force may be further enhanced by the recess 260*c*.

In other words, through the structure and shape of the above-mentioned connection support member 260, the thermal insulator 256 may sufficiently enclose the connection support member 260 and it may be possible to increase a contact area between the connection support member 260 and the thermal insulator 256.

The upper and lower portions of the connection support member 260 may be respectively provided with coupling members 266 and 268 which substantially horizontally extend. The coupling members 266 and 268 may be coupled to the connection support member 260 by a screw 268*a*.

Each of the coupling members 266 and 268 may be provided with an axial hole 268*b* through which the first rotary shaft 42 of the first hinge member 40 is inserted. The connection support member 260 may be provided with an axial hole 278 through which the second rotary shaft 206 of the second hinge member 200 is inserted. A separate member instead of the connection support member 260 may be provided with an axial hole through which the second rotary shaft 206 is inserted. For example, the mounting member 270 having an axial hole 272*a* may be provided and the mounting member 270 may be coupled to the connection support member 260 (see FIG. 9). By such a configuration, since the connection support member 260 and the mounting member 270 are located between the inside panel 254 and the outside panel 252 in a state of being coupled to each other, it may be possible to prevent misalignment between the axial hole of the first hinge member 40 and the axial hole of the second hinge member 200 due to foam pressure when thermal insulator 256 is foamed between the inside panel 254 and the outside panel 252.

In other words, each of the coupling members 266 and 268, which are respectively to the upper and lower portions of the connection support member 260 vertically extending within the door and extend in a width direction (left or right direction) of the door, may be formed the axial hole 268*b* for insertion of the first rotary shaft 42. At each of a lower position of the upper coupling member 268 and an upper position of the lower coupling member 266, the mounting member 270 coupled to the connection support member 260 may be formed with an axial hole 272*a* for insertion of the second rotary shaft 206. Of course, the axial holes 268*b* and 272*a* may be vertically and linearly aligned and have the same axis on the same line. Here, the connection support member 260, the coupling members 266 and 268, and the mounting member 270 may form one assembly by being coupled to each other and may have sufficient rigidity. For example, they may be made of a metal material and be securely coupled to each other by a screw and the like. That is, they may be structurally coupled to each other. For this reason, even when pressure by foaming of the thermal insulator 256 is generated, it may be possible to previously prevent deformation or distortion of the axis on the same line formed by the axial holes 268*b* and 272*a*.

Particularly, a space in which the thermal insulator 256 is filled is formed within the door, through the inside panel 254, the outside panel 252, the upper coupling member 268, the lower coupling member 266. The connection support member 260 is structurally fixed within the door. In other words, after the rotary shaft of the first hinge member 40 is structurally aligned with the rotary shaft of the second hinge member 200, the thermal insulator 256 is foamed so that the connection support member 260 is buried in the thermal insulator 256. Accordingly, the connection member may be structurally rigid without a loss of the alignment by the foaming of the thermal insulator 256.

It is preferable that a cut portion 264 is provided at a predetermined position of the connection support member 260 and the mounting member 270 for mounting the second hinge member 200 is coupled to the cut portion 264. In addition, the mounting member 270 is preferably coupled with the bracket 280. In such a configuration, the second hinge member 200 is coupled to the mounting member 270 through an opening portion 281 of the bracket 280. The mounting member 270 and the bracket 280 may be preferably made of a material having a predetermined rigidity or more. For example, the mounting member 270 may be made of aluminum and the bracket 280 may be made of steel.

Meanwhile, according to another embodiment, the upper portion of the connection support member 260 may be provided with an axial hole through which the first rotary shaft 42 of the first hinge member 40 is directly inserted. That is, the connection support member 260 may be together provided with the axial hole for the first rotary shaft 42 of the first hinge member 40 (or first rotary shaft when the axial hole is provided in the first hinge member 40) and the axial hole for the second rotary shaft 206 of the second hinge member 200 (or second rotary shaft when the axial hole is provided in the second hinge member 200). In this case, since all of the axial hole of the first rotary shaft 42 and the axial hole of the second rotary shaft 206 are provided in the connection support member 260, it may be possible to prevent misalignment between the axial hole of the first rotary shaft 42 and the axial hole of the second rotary shaft 206 due to foam pressure when the thermal insulator 256 is foamed between the inside panel 254 and the outside panel 252. In addition, similarly to the above configuration, it may also be configured that the axial hole for inserting the first rotary shaft 42 of the first hinge member 40 and the axial hole for inserting the second rotary shaft 206 of the second hinge member 200 are formed on a separate member instead of the connection support member 260 and the axial holes are coupled to the connection support member 260.

The mounting member 270 will be described in more detail with reference to FIG. 9.

The mounting member 270 basically includes a seating portion 272 for mounting the second hinge member 200. It is preferable that an upper portion of the seating portion 272 is provided with a space having a predetermined depth so as to increase convenience of assembly when the second hinge member 200 is assembled to the seating portion 272. The mounting member 270 may be received in the receiving portion 232 of the door 20. Thus, the mounting member 270 may be a receiving portion 232 and the predetermined space defined by the mounting member 270 may be a receiving space for receiving the second hinge member 200. An axial hole 272*a* for inserting the second rotary shaft 206 of the second hinge member 200 is provided at a predetermined position of the seating portion 272. The axial hole 278 may be provided with a circular bush 272*b* and the second rotary shaft 206 of the second hinge member 200 may be inserted into the bush 272*b* so as to easily rotate the second hinge member 200.

Although the present embodiment shows that the second rotary shaft 206 is provided in the second hinge member 200 and the axial hole 272*a* corresponding to the second rotary shaft 206 is provided in the seating portion, the present invention is not limited thereto. For example, the second rotary shaft 206 may also be provided in the seating portion 272 and the axial hole 272*a* corresponding to the second hinge member 200 may also be provided.

The front of the seating portion 272 may be provided with an opening portion 271 corresponding to the opening portion (see FIG. 7) of the receiving portion 232 and the rear of the seating portion 272 may be provided with a partition wall 274 substantially corresponding to the shape of the second hinge member 200. Coupling portions 276 coupled to the connection support member 260 is preferably provided at the left and the right of the seating portion 272. It is preferable that each of the coupling portion 276 is provided with a hole 276*a* for screw coupling and the connection support member 260 is provided with a hole 268*c* corresponding to the same so that the mounting member 270 and the connection support member 260 are coupled by a screw.

In more detail, in the present embodiment, the receiving portion 232 for receiving the second hinge member 200 may be formed through the mounting member 270. That is, a space may be formed by the seating portion 272 and the partition wall 274 such that the second hinge member 200 may be rotatably received in the space. The partition wall 274 may backwardly protrude so as to pass through the cut portion 264 of the connection support member 260 or match with the cut portion 264. The upper portion of the mounting member 270 may be formed with an upper surface facing the seating portion 272.

Accordingly, when the mounting member 270 and the connection support member 260 are separately provided, the loads applied to the second hinge member 200 may be transferred to the connection support member 260 through the mounting member 270.

Meanwhile, as shown in FIGS. 6 and 7, an opening and closing member 290 for selectively opening and closing the opening portion 234 during opening and closing of the door 20 is preferably provided at a predetermined position of the opening portion 234 of the receiving portion 232 of the door 20. When the door 20 is opened, the opening portion 234 of the receiving portion 232 is exposed to the outside of the refrigerator. When such a state is maintained, foreign matters may be introduced through the opening portion 234 and aesthetic feeling is reduced. Therefore, the opening and closing member 290 is preferably used.

Figure 10:
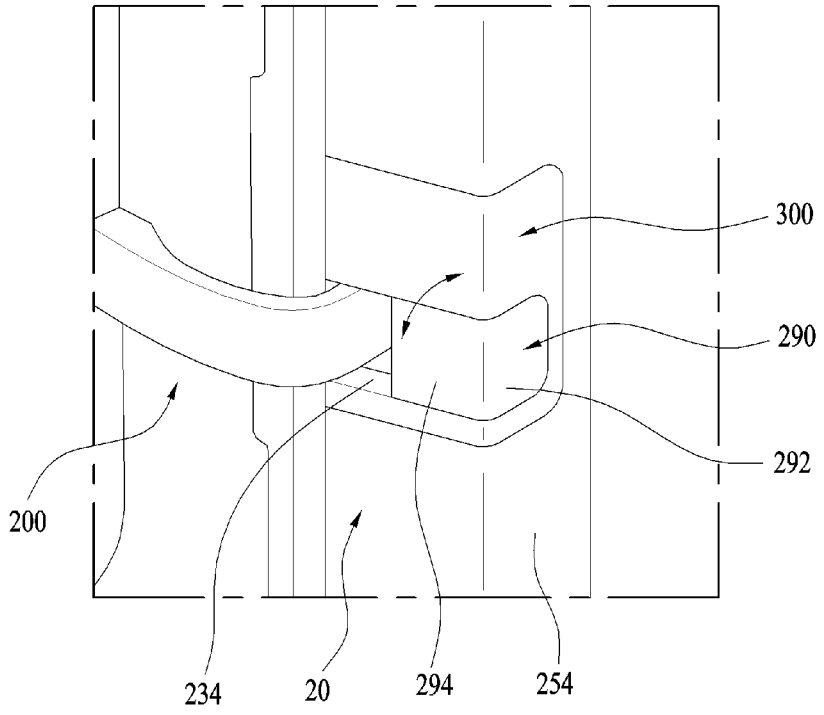
FIG. 10 is a perspective view schematically illustrating an opening and closing member of FIG. 7.

The opening and closing member 290 will be described in more detail with reference to FIG. 10.

The opening and closing member 290 includes an opening and closing portion 294 for selectively opening and closing the opening portion 234 of the receiving portion 232 of the door 20. One side of the opening and closing portion 294 is connected with the coupling portion 292 coupled to the door. The opening and closing portion 294 preferably has a shape substantially corresponding to the shape of the opening portion 234. The opening and closing portion 294 is made of an elastic material. When the door 20 is opened, the opening and closing portion 294 is unfolded by elasticity of the opening and closing portion 294 so as to cover the opening portion 234 of the door 20 (see FIG. 7). When the door 20 is closed, the opening and closing portion 294 is compressed by the second hinge member 200 so as to enter the inside of the opening portion 234 of the door 20 (see FIG. 6).

In other words, the opening and closing member 290 may always come into contact with the connection portion 209 of the second hinge member 200 regardless of the rotation position of the second hinge member 200. For example, the opening and closing member 290 is deformed in a folded direction as a gap between the connection portion 209 of the second hinge member 200 and the opening and closing member 290 becomes narrower. On the other hand, the opening and closing member 290 is preferably deformed in an unfolded direction.

The opening and closing member 290 covers a gap between the opening portion 234 and the connection portion 209 of the second hinge member 200 through the opening and closing member 290. Accordingly, it may be possible to minimize a gap between the opening portion 234 and the connection portion 209 at a position for operating the door by the user. Thus, it may be possible to minimize exposure of the gap between the opening portion 234 and the connection portion 209 so as to increase reliability and prevent introduction of foreign matters through the gap.

Meanwhile, although the opening and closing member 290 may also be directly coupled to the door 20, the present invention is not limited thereto. For example, a housing 300 may also be coupled to the door 20 and the opening and closing member 290 may also be coupled to the housing 300. The housing 300 may be a separate configuration and the bracket 280 (see FIG. 7) coupled to the inside panel 254 of the door 20 may also be used as the housing 300. Thus, it may be possible to improve convenience of assembly.

Figure 11:
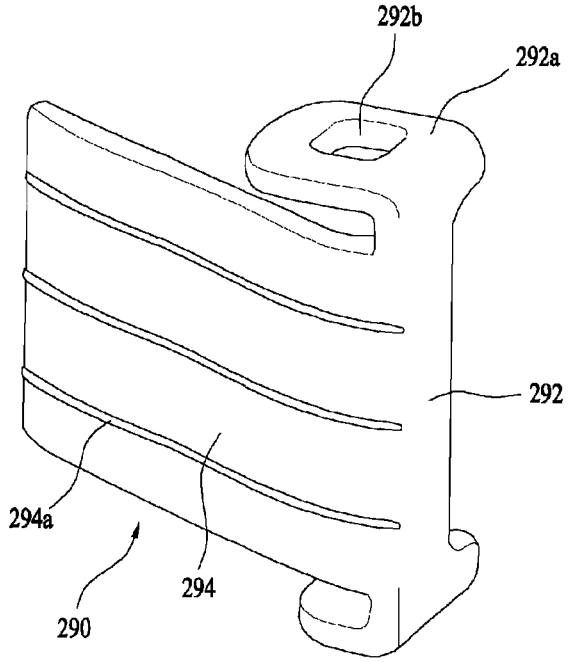
FIG. 11 is a front perspective view illustrating a modified example of the opening and closing member of FIG. 10.
Figure 12:
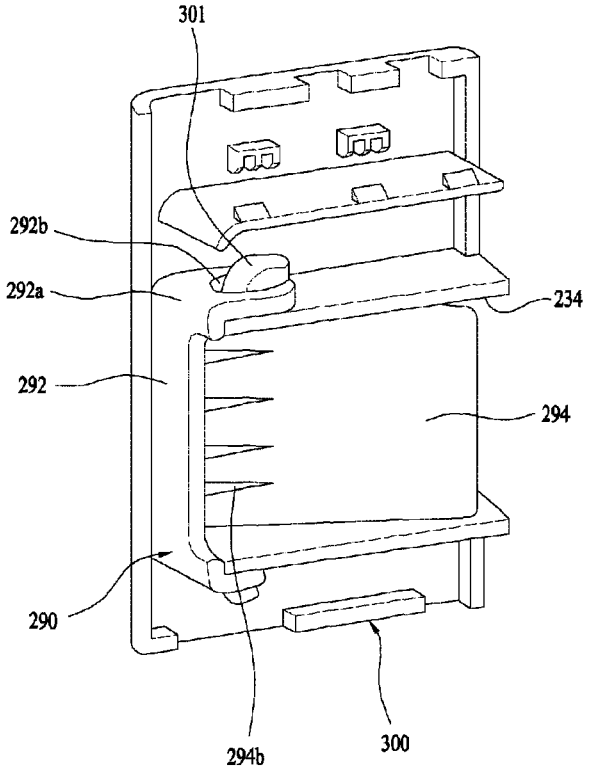
FIG. 12 a rear perspective view illustrating a mounted state of the opening and closing member of FIG. 11.

The preferable embodiment of the opening and closing member 290 and the housing 300 will be described with reference to FIGS. 11 and 12.

A rib 294*a* is preferably formed on a front surface of the opening and closing portion 294 of the opening and closing member 290. The rib 294*a* may have a band shape which has a small width and forwardly protrudes. The rib 294*a* may minimize a contact area between the opening and closing portion 294 and the second hinge member 200, particularly the connection portion 209 of the second hinge member 200 so as to reduce friction force. By such a configuration, it may be possible to effectively prevent the opening and closing portion 294 from protruding to the outside instead of the inside of the opening portion 234 of the door 20 by friction force with the second hinge member 200. In addition, since the second hinge member 200 comes into linear contact with the rib 294*a* of the opening and closing portion 294, it may be possible to prevent entire contamination of the opening and closing portion 294.

Meanwhile, the opening and closing portion 294 may be connected to the coupling portion 292 such that the opening and closing portion 294 is inclined inward of the coupling portion 292, namely in a folded direction of the opening and closing portion 294 by a predetermined angle. The rib 294*b* is preferably provided at a connection part (rear surface of the in a folded direction of the opening and closing member) between the in a folded direction of the opening and closing portion 294 and the coupling portion 292. When the opening and closing portion 294 is folded by the second hinge member 200, a connection part at which the rib 294*b* is formed may be effectively induced to be folded by the rib 294*b*. In addition, restoration of the opening and closing portion 294 when the opening and closing portion 294 is folded and is then returned again may be smoothly performed by the rib 294*b*.

Meanwhile, upper and lower portions of the coupling portion 292 may be provided with connection portions 292*a* which substantially extend at a right angle in a direction of the opening and closing portion 294, and each of the connection portions 292*a* may be provided with an assembly hole 292*b*. A hook 301 of the housing 300 is coupled to the assembly hole 292*b* such that the opening and closing member 290 may be easily coupled to the housing 300.

The shape of the fixed portion 208 of the second hinge member 200 and the container 100 will be described with reference to FIG. 13.

As described above, in order to support the loads of the container 100, it is preferable that the connection support member 260 is provided in the door 20, the rotation portion 210 of the second hinge member 200 is connected to the connection support member 260, and the fixed portion 208 of the second hinge member 200 is coupled to a member having a predetermined rigidity. For example, the container 100 preferably includes a frame 110 having a predetermined rigidity and a basket 120 coupled to the frame 110. The basket is preferably made of a material such as plastic.

The frame 110 may be provided in the front of the container 100, and may substantially define and maintain an external appearance of the container 100. Accordingly, the frame 110 may have a square shape which corresponds to the square shape of the container 100 and is formed as a closed loop. The frame 110 may be made of a metal material for having sufficient rigidity as well as a closed loop shape. The frame 110 may be formed by bending a hollow pipe substantially having many empty portions. Accordingly, the thickness of the frame 110 in the forward and backward direction thereof may be reduced, thereby preventing a reduction of the storage space of the container 100.

Meanwhile, it is preferable that a groove 112 is provided at a predetermined position and the fixed portion 208 of the second hinge member 200 is inserted into the groove 112 so as to the frame 110 is coupled to the second hinge member 200 by a screw 110*a*.

Figure 13:
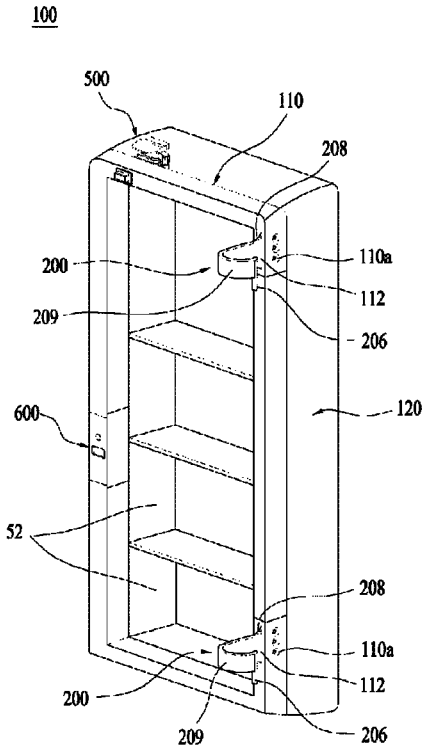
FIG. 13 is a perspective view schematically illustrating the container of FIG. 1.

As shown in FIG. 13, the second hinge member 200 may be formed by bending a substantial plate-shaped member as a desired shape. The rotation portion of the second hinge member 200 may be provided with the second rotary shaft 206. The fixed portion 208 of the second hinge member 200 may use an area wider than other part so as to enhance bonding force between the fixed portion 208 and the frame 110 of the container 100. Meanwhile, FIG. 13 shows that the second hinge member 200 is formed in a vertical plate shape. By such a shape, it may be possible to more easily support a bending load downwardly applied to the second hinge member 200.

The embodiments in which the rotary shaft 42 of the first hinge member 40 and the rotary shaft 206 of the second hinge member 200 have the same axis have been described above. That is, a description has been given with respect to the vertical and linear alignment of the rotary shafts 42 and 206. However, it is not necessary that the rotary shafts have the same axis. Hereinafter, an embodiment of rotary shafts having different axes will be described.

Figure 14:
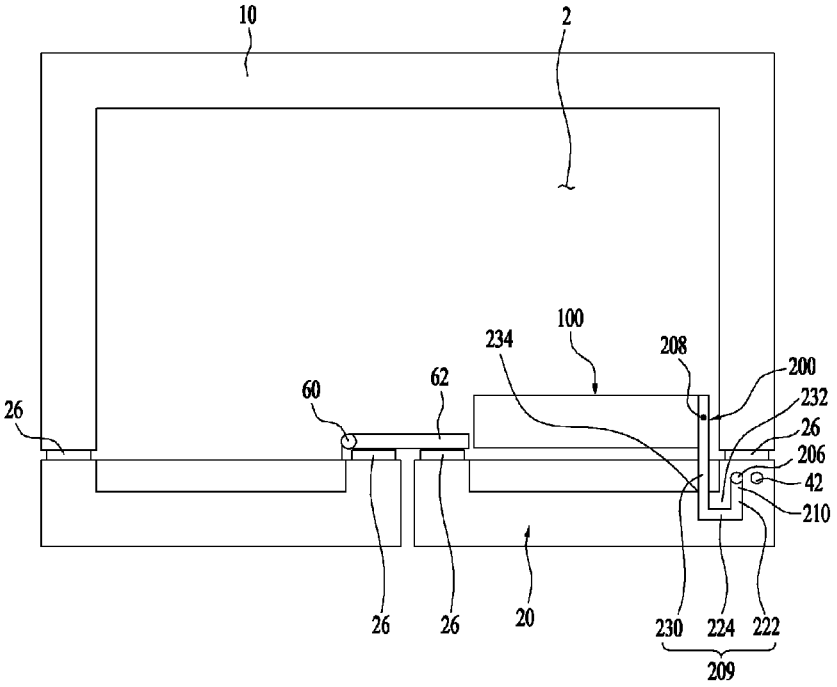
FIG. 14 is a view illustrating a closed state of a door in another embodiment of the present invention.
Figure 15:
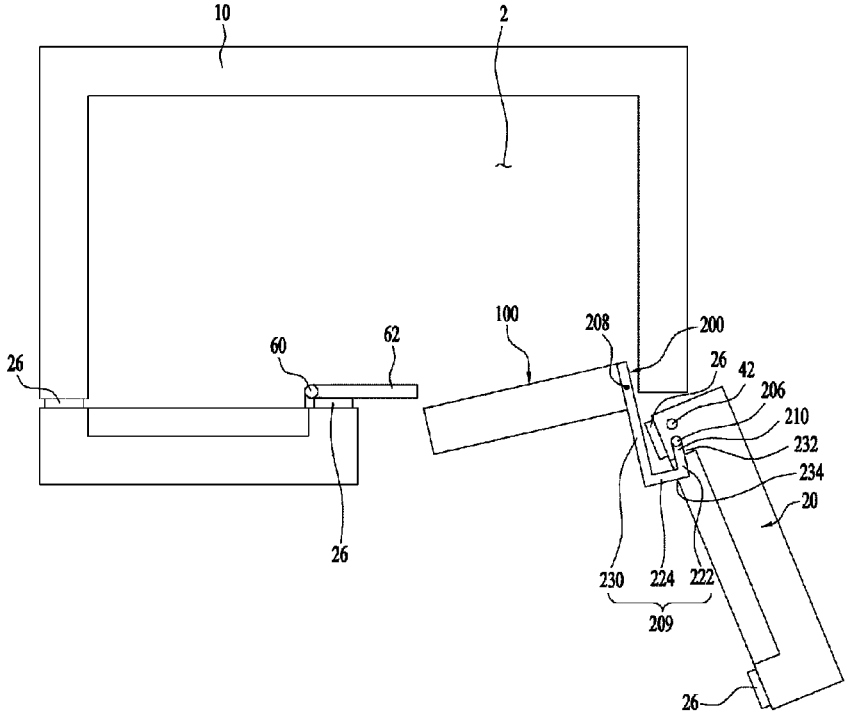
FIG. 15 is a view illustrating an opened state of the door in another embodiment of the present invention.

FIG. 14 is a view illustrating a closed state of an external door in another embodiment of the present invention. FIG. 15 is a view illustrating an opened state of the external door in another embodiment of the present invention. Hereinafter, a description will be given with reference to FIGS. 14 and 15.

Unlike the embodiment described in FIGS. 4 and 5, in another embodiment of the present invention, the rotary shaft 42 of the first hinge member 40 and the rotary shaft 206 of the second hinge member 200 do not have the same axis when viewed from above. That is, the rotary shaft 206 and the rotary shaft 42 of the first hinge member 40 have different heights and are installed at different positions.

Accordingly, when the door 20 is rotated to be away from the container 100, one side of the container 100 is withdrawn toward the front of the cabinet 10. It is because the rotary shaft 206 about which the container 100 rotates is rotated relative to the rotary shaft 42.

Since the second hinge member 200 is formed so as not to come into contact with the gasket 26, the second hinge member 200 may have a form varied according to a moving trajectory of the gasket 26. However, the form and shape of the second hinge member 200 shown in FIGS. 14 and 15 are equal to or similar to the form and shape of the second hinge member 200 shown in FIGS. 4 and 5. That is, the form and shape of the second hinge member 200 shown in FIGS. 4 and 5 are applicable to the embodiment of FIGS. 14 and 15, and each component of the second hinge member 200 performs the same function. Accordingly, no description will be given with respect to portions related to the same technique.

Meanwhile, the second hinge member 200 according to another embodiment of the present invention may be installed close to the center of the cabinet 10 rather than the rotary shaft 42 of the first hinge member 40. That is, the second rotary shaft 206 may be formed closer to the center of the cabinet 10 within the door 20 compared to the first rotary shaft 42. In other words, second rotary shaft 206 of the second hinge member 200 may be located closer to the handle portion 22 than the first rotary shaft 42 of the first hinge member 40. Thus, a space for installation of the second hinge member 200 to the door 20 may be reduced. That is, the receiving space of the receiving portion 232 may be reduced. In other words, a space occupied by foaming agent may be further increased. Therefore, due to the shape of the second hinge member 200, it may be possible to reduce a portion in which the thickness of the door 20 becomes thinner and to prevent deterioration of thermal insulation performance of the door 20.

However, in the present embodiment, when the door is rotated relative to the cabinet, the door interferes with the container through the second hinge member 200. Of course, the container may be rotated independently of the door.

Unlike that shown in FIG. 14, in a closed state of the door, the container may be further rotated to the inside of the first storage region 2. When only the door is opened, the container may be rotated by a certain degree due to interference with the door. When the door is rotated by a predetermined angle or more, the container 100 may protrude to the outside of the first storage region. Thus, similarly to the above embodiments, in the present embodiment, a maximum opening angle of the door relative to the container may be defined.

That is, when the door is opened by the maximum opening angle of the door relative to the container, the present embodiment may allows a space in which the container 100 is rotated in the first storage region by a predetermined angle. Thus, even when the door is opened by the maximum opening angle, the container 100 may be maintained in a state of being received in the first storage region.

The above-mentioned stopper, locking device, locking member, and fixing device may be similarly applied to the present embodiment. In addition, the above-mentioned connection support member 260 may be similarly applied to the present embodiment. It is because the alignment and relative position between the rotary shaft 42 of the first hinge member 40 and the rotary shaft 206 of the second hinge member 200 intended through the connection support member 260 may be securely maintained.

The characteristics of shape or form of the second hinge member 200 for preventing deterioration of thermal insulation performance and the characteristics of different axes between the first hinge member 40 and the second hinge member 200 have been described above. Of course, regardless of the same axis and different axes, it may be possible to improve thermal insulation performance through the characteristics of shape or form of the second hinge member 200.

Hereinafter, another embodiment for improving thermal insulation performance of the door 20 will be described with reference to FIGS. 16 to 22. The present embodiment may be applied to regardless of or independently of the characteristics of the above-mentioned embodiment. Of course, the characteristics of the above-mentioned embodiment may also be complexly applied to the present embodiment.

Figure 16:
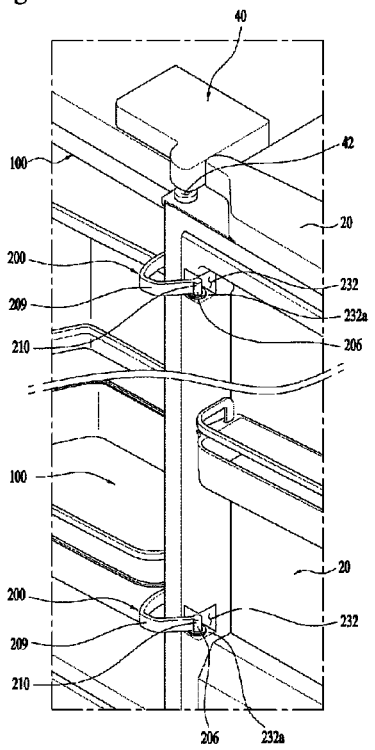
FIG. 16 is a view illustrating a coupled portion of the second hinge member and the door in the embodiment of the present invention.

FIG. 16 is a view illustrating a portion in which the second hinge member 200 is mounted to the door 20 in the embodiment of the present invention. As shown in the drawing, the second hinge members 200 may be respectively mounted to the upper and lower portions of the door 20. The second hinge members 200 mounted to the upper and lower portions may have the same shape and be mounted to the receiving portions 232 having the same shape.

The door 20 may be formed with a recess 232 recessed by a predetermined depth. The recess 232 may be a receiving portion 232 for receiving the second hinge member 200. The receiving portion 232 may be formed by being recessed inward of the door 20 from the inner surface of the door 20 (in a thickness reduction direction of the door).

The receiving portion 232 may be have a shape in which the inner surface of the door 20 or a portion of the inside panel 254 is cut. The receiving portion 232 may be provided with a mounting surface 232*a*. The mounting surface 232*a* may be formed in a plane. The second hinge member 200 may be mounted to the mounting surface 232*a*. That is, the second rotary shaft 206 formed in the rotation portion 210 of the second hinge member 200 may be rotatably fixed to the mounting surface 232*a*.

Accordingly, when the second hinge member 200 is rotated about the second rotary shaft 206, the container 100 may be rotated relative to the door 20. That is, the container 100 coupled with the fixed portion 208 (see FIG. 4) of the second hinge member 200 is integrally rotated about the second rotary shaft 206 along with rotation of the connection portion 209 of the second hinge member 200. In this case, at least a portion of the connection portion 209 of the second hinge member 200 enters through the opening portion 234 of the receiving portion 232.

Due to such a receiving portion 232, a portion in which the receiving portion 232 is formed may be relatively thinner compared to portions having different thickness of the door 20. That is, the portion in which the receiving portion 232 is formed may cause deterioration of thermal insulation performance.

Accordingly, the present embodiment teaches that a reinforced thermal insulator 256 is installed to the portion in which the receiving portion 232 within the door 20 so as to increase thermal insulation effects.

Figure 17:
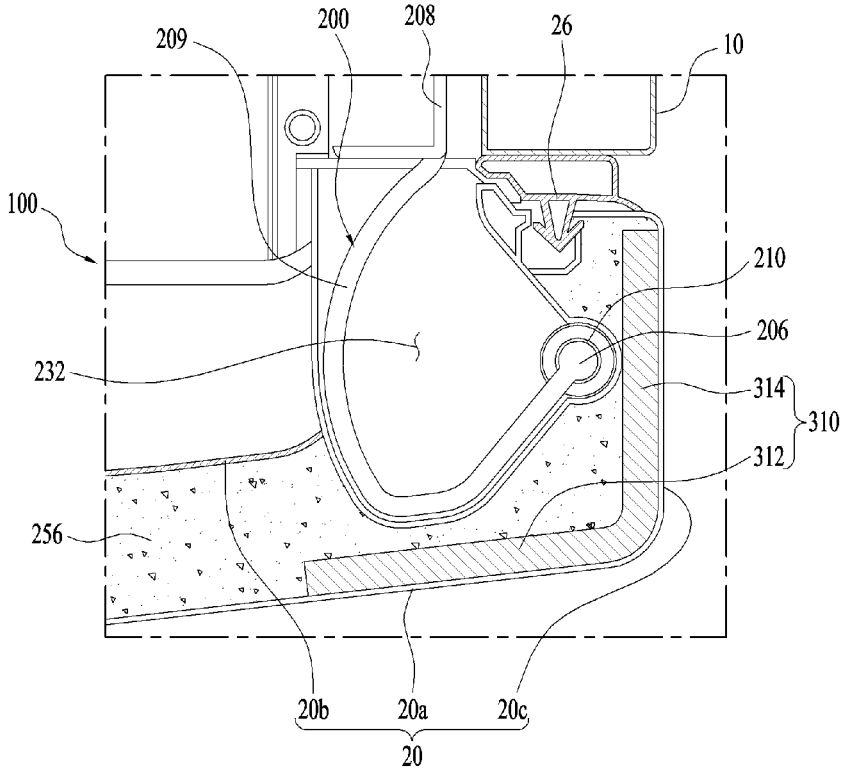
FIG. 17 is a plane cross-sectional view illustrating a reinforced thermal insulator in FIG. 16.

FIG. 17 is a plane cross-sectional of FIG. 16. Hereinafter, a description will be given with reference to FIG. 17.

The door 20 may include an inner wall 20*b* forming an inner side surface of the door 20, outer walls 20*a* and 20*c* defining an external appearance of the door 20, a thermal insulator 256 filled between the inner wall 20*b* and the outer walls 20*a* and 20*c*, and a reinforced thermal insulator 310 having thermal conductivity lower than the thermal insulator 256. The inner wall 20*b* and the outer walls 20*a* and 20*c* of the door 20 may be formed through the inside panel 254 of the outside panel 252 shown in FIG. 8. The thermal insulator 256 may be a thermal insulator which is typically foamed and filled, or a urethane thermal insulator.

The inner wall 20*b* is provided to face the first storage region 2 and may be made of an ABS material. In this case, the inner wall 20*b* has a predetermined thickness and prevents the inside of the door 20 from being exposed to the user so as to give aesthetic feeling to the user.

On the other hand, the outer walls 20*a* and 20*c* may be a portion exposed to the user when the door 20 closed the first storage region 2, and may be made of a material such as steel. That is, the outer walls 20*a* and 20*c* may be a portion viewed from the outside of the refrigerator in a closed state of the door 20. The outer walls 20*a* and 20*c* may be classified into a side outer wall 20*c* forming a side surface of the door 20 and a front outer wall 20*a* forming a front surface of the door 20. In this case, the side outer wall 20*c* and the front outer wall 20*a* are bent therebetween by a predetermined angle such that the side outer wall 20*c* and the front outer wall 20*a* may be classified into each other.

The side outer wall 20*c* and the front outer wall 20*a* may be classified through an edge. As shown in FIG. 8, the side outer wall 20*c* and the front outer wall 20*a* may be integrally formed through the outside panel 252.

In this case, since the reinforced thermal insulator 310 has thermal conductivity lower than the thermal insulator 256, a thermal conductivity effect may be reduced through the reinforced thermal insulator 310. Particularly, the reinforced thermal insulator 310 may be a vacuum thermal insulator which is substantially vacuumized therein.

The reinforced thermal insulator 310 may have a plate shape which is vacuumized therein. Since the reinforced thermal insulator 310 is vacuumized therein, it may have a lower thermal conductivity. In this case, the reinforced thermal insulator 310 forms one closed space and may be coupled to inner peripheral surfaces of the outer walls 20*a* and 20*c*.

As described above, the receiving portion 232 is provided in the door 20. Accordingly, the portion in which the receiving portion 232 is formed may have a thinner thickness compared to other portions of the door 20. Thus, the reinforced thermal insulator 310 may be provided in the door 20 so as to correspond to the shape of the receiving portion 232. When the shape size of the receiving portion 232 is increased, the shape size of the reinforced thermal insulator 310 may be increased. In addition, when the shape of the receiving portion 232 is varied, the reinforced thermal insulator 310 may be deformed corresponding to the varied shape of the receiving portion 232.

That is, the reinforced thermal insulator 310 reinforces thermal insulation of the thinner portion of the door 20 caused by the receiving portion 232. It is because when only the thermal insulator 256 is applied without using the reinforced thermal insulator 310, sufficient thermal performance may not be realized since the thermal insulator 256 has a relatively larger thermal conductivity than the reinforced thermal insulator 310.

The reinforced thermal insulator 310 is preferably provided on the side outer wall 20*c* and the front outer wall 20*a* of the outer walls 20*a* and 20*c*. That is, the reinforced thermal insulator 310 may be provided at the edge of the outer walls 20*a* and 20*c*.

The reinforced thermal insulator 310 may include a first contact portion 312 and a second contact portion 314. The first contact portion 312 may be installed to the front outer wall 20*a* and the second contact portion 312 may be installed to the side outer wall 20*c*. In this case, the first contact portion 312 and the second contact portion 314 may be bent while forming the same angle as the bent angle of the front outer wall 20*a* and the side outer wall 20*c*.

Meanwhile, it is preferable that the contact portion 312 and the second contact portion 314 are integrally formed such that an inner space between the contact portion 312 and the second contact portion 314 is vacuumized. In this case, the reinforced thermal insulator 310 may generally have a "¬" shape.

Accordingly, it may be possible to reinforce thermal insulation performance of a portion in which the thickness of the door 20 becomes thinner by a recessed shape of the receiving portion 232.

Meanwhile, since the inside of the door 20 may be manufactured by a method of filling the thermal insulator 256, the thermal insulator 256 may be filled in a state in which the reinforced thermal insulator 310 is attached inside the outer walls 20*a* and 20*c*. Since the reinforced thermal insulator 310 is primarily fixed to the outer walls 20*a* and 20*c* by bonding and is then secondarily fixed thereto by filling of the thermal insulator 256, strong bonding may be performed between the reinforced thermal insulator 310 and the door 20.

Figure 8:
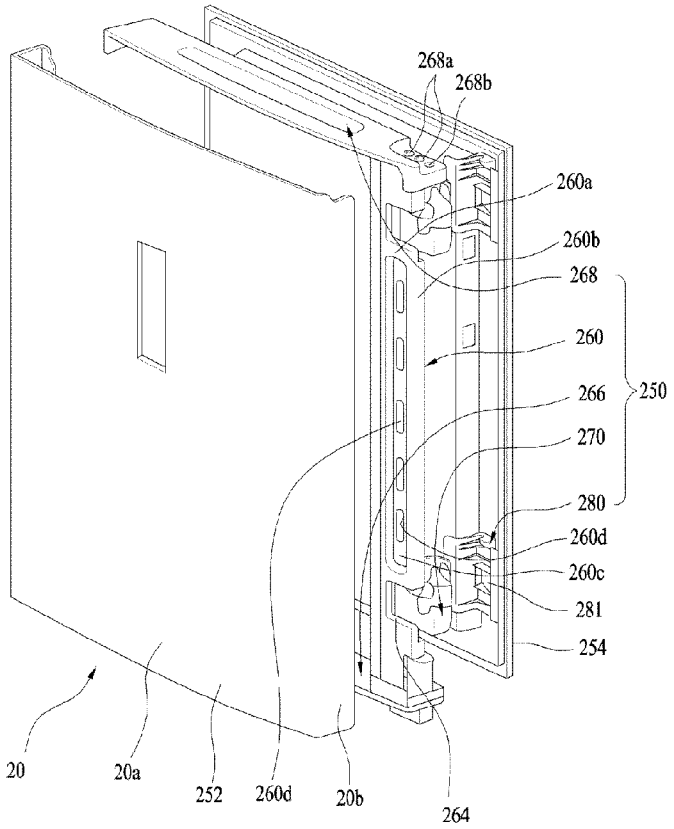
FIG. 8 is an exploded perspective view illustrating an embodiment of a door and an embodiment of a connection member in the embodiment of the present invention.
Figure 9:
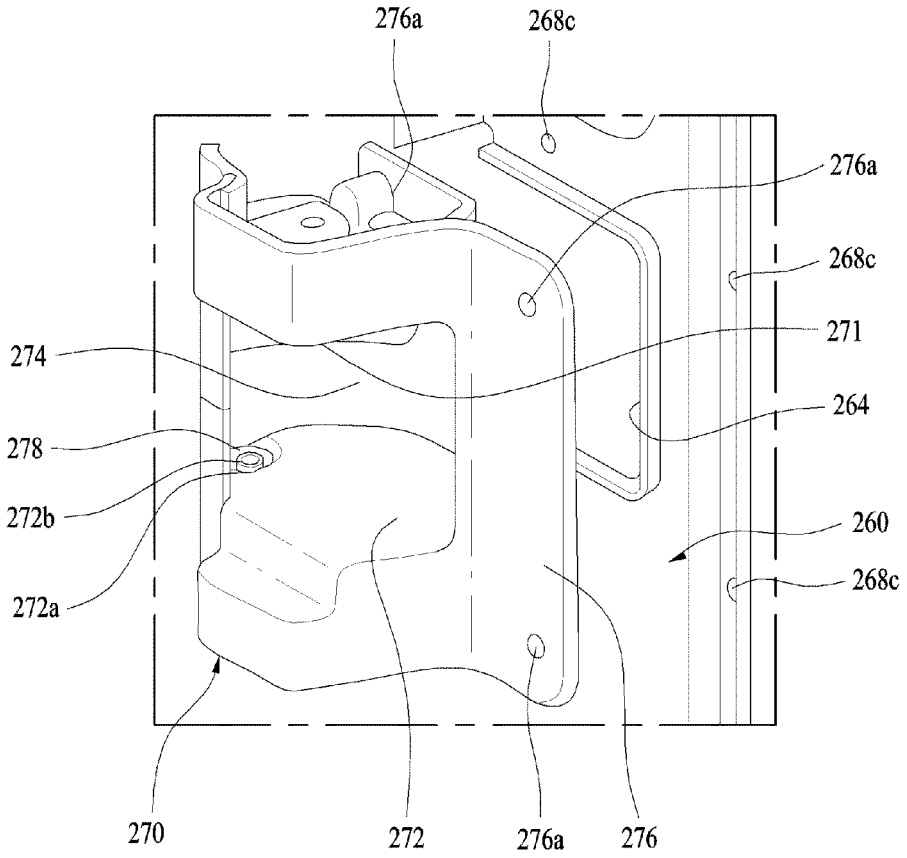
FIG. 9 is a perspective view illustrating a mounting member of FIG. 8.

Of course, the reinforced thermal insulator 310 may be substantially and entirely provided in a vertical direction of the outside panel 252 shown in FIG. 8. That is, the reinforced thermal insulator 310 may be entirely provided on an edge portion of one side corresponding to receiving portion 232. However, the reinforced thermal insulator 310 may also be respectively provided at two positions corresponding to the receiving portion 232. It is because it may be possible to obtain sufficient thermal insulation performance by filling of basic thermal insulator since the thickness of the door 20 is not thinned at a portion between two receiving portions 232.

Figure 18:
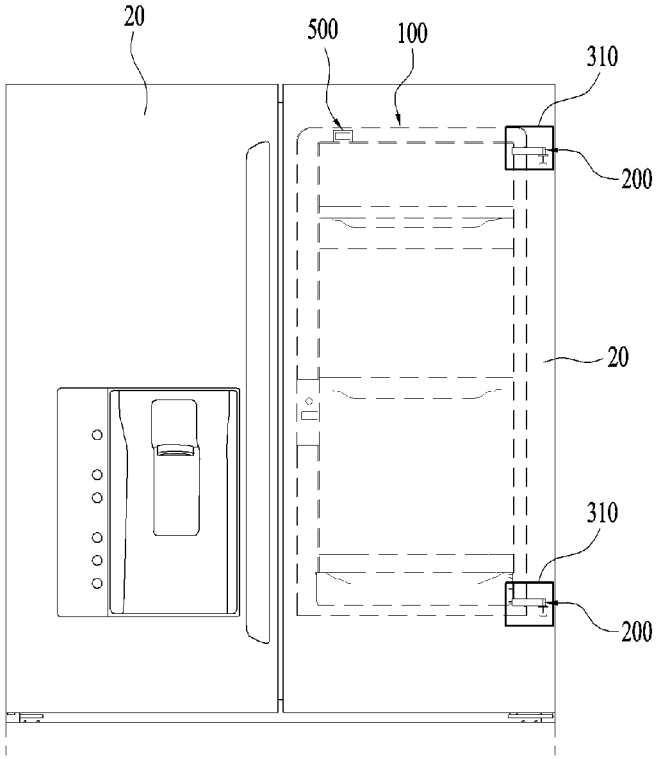
FIG. 18 is a view illustrating the refrigerator shown in FIG. 16 when viewed from the front.

FIG. 18 is a view illustrating the refrigerator shown when viewed from the front. Hereinafter, a description will be given with reference to FIG. 18.

A vertical length of the reinforced thermal insulator 310 may be the same as a vertical length of the formed portion of the receiving portion 232. Meanwhile, since the second hinge member 200 is installed to the receiving portion 232, the reinforced thermal insulator 310 is preferably installed to be equal to or greater than a vertical length of the second hinge member 200. The reinforced thermal insulator 310 may improve thermal insulation performance of the door 20 since it is installed to the thinner portion of the door 20.

In a portion in which the reinforced thermal insulator 310 is not installed in the door 20, the thickness of the door 20 may be sufficiently obtained. Therefore, the reinforced thermal insulator 310 need not be installed.

Meanwhile, sine the second hinge member 200 is installed at two positions of the door 20, two reinforced thermal insulators 310 are preferably installed at the two positions of the door 20 so as to correspond to the positions of the second hinge members 200.

FIG. 19 is a view for explaining thermal insulation performance in an uninstalled state of the reinforced thermal insulator 310. FIG. 20 is a table for explanation of FIG. 19. Hereinafter, a description will be given with reference to FIGS. 19 and 20.

On the basis of the door 20, Tout refers to an outdoor air temperature (an air temperature in the front of the door), T1 refers to an outer surface temperature of the door (a temperature directly coming into contact with outdoor air in the door), and Tin refers an indoor air temperature (a temperature within the first storage region).

For comparison, assuming Tout is 32.2° C. and Tin is 3° C. Assuming the thickness of the outer wall 20*a* is 0.0005 m, the thickness of the thermal insulator 256 is 0.0119 m, and the thickness of the inner wall 20*b* is 0.0015 m.

In this case, T1 may be measured as 27.9° C. In this case, it may be known that a difference between Tout and T1 is 4.3° C.

FIG. 21 is a view for explaining thermal insulation performance in an installed state of the reinforced thermal insulator 310. FIG. 22 is a table for explanation of FIG. 21. Here, the reinforced thermal insulator 310 is exemplified as a vacuum insulating plate. Hereinafter, a description will be given with reference to FIGS. 21 and 22.

FIG. 21 shows that the reinforced thermal insulator 310 is applied. The thickness of the reinforced thermal insulator 310 is 0.008 m, and the thickness of the thermal insulator 256 is a reduced 0.0039 m. However, a sum of the thicknesses of the reinforced thermal insulator 310 and the thermal insulator 256 is equal to 0.119 m which is the thickness of the thermal insulator described in FIG. 19. That is, all conditions are the same except for a usage state of the reinforced thermal insulator 310. In other words, all conditions are the same except for replacement the thermal insulator 256 with the reinforced thermal insulator 310 having a lower thermal conductivity.

In this case, T1 may be measured as 29.9° C. In this case, it may be known that a difference between Tout and T1 is 2.3° C. That is, it may be known that a difference between Tout and T1 is reduced by 2.0° C. by means of using the reinforced thermal insulator 310. In other words, it may be known that thermal insulation performance is improved. Of course, such a difference is indicated by a difference between Tin and a temperature of the door inner surface (T4 or T5). It may be known that thermal insulation performance is improved as the difference becomes smaller.

It may be possible to effectively prevent dew formation on the outer surface of the door as the temperature difference, particularly a difference between Tout and T1 becomes smaller. Of course, it may be possible to effectively prevent dew formation on the inner surface of the door as a difference between Tin and a temperature of the door inner surface (T4 or T5) becomes smaller.

It may be possible to efficiently and relatively use energy in addition to a dew formation effect. It is because, for example, energy required for maintaining the first storage region 2 at 3° C. is relatively decreased. Accordingly, when the reinforced thermal insulator 310 is applied to a portion in which the thickness of the door 20 is reduced, a thermal insulation effect may be obtained to a desired degree. Particularly, when the receiving portion 232 for receiving a hinge is formed within the door 20 in order to rotatably fix the container 100 to door 20, it may be possible to effectively obtain thermal insulation performance.

The embodiment of the connection support member 260 which distributes the loads of the container 100 from the second hinge member 200 to the first hinge member 40 has been described above. The connection support member 260 may distribute the loads of the container 100 to entirety within the door by increasing a contact area with the thermal insulator 256 within the door 20.

Another embodiment of the connection member will be described below. For convenience of description, the connection member according to the present embodiment refers to reference numeral 700. The connection member according to the present embodiment may basically have characteristics in connection with the first and second hinge members 40 and 200 provided in the lower portion of the door. The above-mentioned embodiment may basically have characteristics in connection with the first and second hinge members 40 and 200 which are respectively provided in the upper and lower portions of the door. Accordingly, the connection member 700 according to the present embodiment may also be complexly realized in connection with the connection support member 260 of the above-mentioned embodiment. In this case, the above-mentioned connection support member 260 may refer to a main connection member and the connection member 700 according to the present embodiment may refer to an auxiliary connection member. Of course, the connection member 700 according to the present embodiment may also be realized regardless of the above-mentioned connection support member 260.

Figure 23:
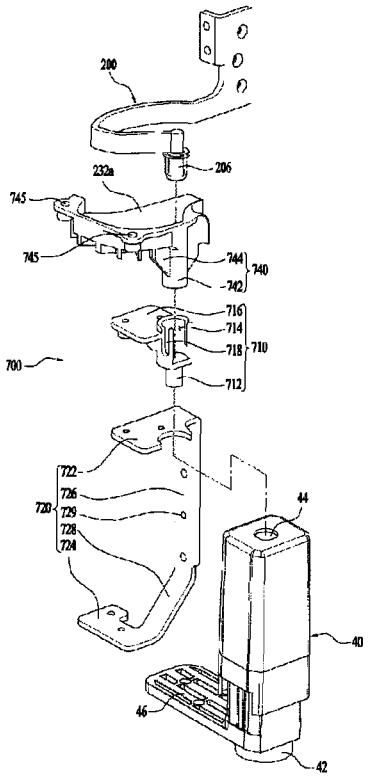
FIG. 23 is an exploded perspective view illustrating another embodiment of a connection member.

FIG. 23 is an exploded perspective view illustrating a structure in which the connection member 700 according to the present embodiment is connected with the first and second hinge members 40 and 200. Hereinafter, a description will be given with reference to FIG. 23.

Since the second hinge member 200 has been described, no description will be given thereof.

The first hinge member 40 is arranged at a height lower than the second hinge member 200, and may include a rotary shaft 42 which is a center of rotation of the door 20 relative to the cabinet 10. In addition, the first hinge member 40 may include a connection piece 46 fixed to the door 20.

In this case, the connection piece 46 is provided within the door 20 and may also be installed such that the user using the refrigerator may not view the connection piece 46 with the naked eye.

Particularly, the connection piece 46 extends perpendicular to the rotary shaft 42 of the first hinge member 40 so that the first hinge member 40 stably supports the loads of the door 20 and reinforces a support structure for rotation.

Since the first hinge member 40 is made of a material having greater rigidity than the thermal insulator 256 filled within the door 20, the second hinge member 200 may be more stably supported when the loads of the second hinge member 200 are transferred to the first hinge member 40. That is, the loads of the container 100 coupled with the second hinge member 200 may be transferred to the first hinge member 40 through the second hinge member 200. Accordingly, the second hinge member 200 may more stably support the container 100 such that the container 100 is rotatable. In this case, the first hinge member 40 may be made of an ABS material such as plastic or a metal material such as steel.

The upper side of the first hinge member 40 may be a seating groove 44 recessed by a predetermined depth. The seating groove 44 may have a circular shape, and have the same center as the rotary shaft 42 of the first hinge member 40.

Meanwhile, FIG. 23 shows that a configuration of a portion coupled to the cabinet 10 of the first hinge member 40 is omitted for convenience of description.

As shown in FIG. 23, the connection member 700 of the present embodiment structurally connects the first hinge member 40 and the second hinge member 200. That is, the first and second hinge members 40 and 200 are structurally connected through the connection member 700.

The connection member 700 may be arranged such that the rotary shaft 42 of the first hinge member 40 as a center of rotation of the door 20 and the rotary shaft 206 of the second hinge member 200 as a center of rotation of the container 100 are the same center.

That is, the connection member 700 is arranged such that the first and second hinge members 40 and 200 are connected to each other, and may be easily arranged such that the rotary shaft 42 of the first hinge member 40 and the rotary shaft 206 of the second hinge member 200 form the same center.

The connection member 700 may be provided so as to transfer the loads transferred through the second hinge member 200 to the first hinge member 40. Accordingly, the connection member 700 may structurally directly or indirectly couple the first hinge member 40 and the second hinge member 200.

For indirect coupling between the first hinge member 40 and the second hinge member 200, the connection member 700 may include a first connection member 710.

For example, the connection member 700 may include the first connection member 710 which is provided with a seating protrusion inserted into the seating groove 44.

The seating protrusion 712 may have a circular shape corresponding to the seating groove 44 and be inserted and coupled into the seating groove 44. That is, the first connection member 710 may be coupled at a decided position of the first hinge member 40 by the seating protrusion 712. Thus, an operator may easily select a coupling position between the first hinge member 40 and the first connection member 710 by coupling the seating protrusion 712 to the seating groove 44.

Meanwhile, the seating groove 44 has the same center as the rotary shaft 42 of the first hinge member 40, and thus the seating protrusion 712 has the same center as the rotary shaft 42 of the first hinge member 40.

The first connection member 710 includes a receiving groove 714 disposed an upper side of the seating protrusion 712. The receiving groove 714 may have a predetermined space therein. The receiving groove 714 may have a circular shape which is empty therein. One side of the receiving groove 714 may be formed with a through hole 718 passing through the receiving groove 714 and the outside. The through hole 718 may have a shape such as a slit.

The first connection member 710 may have an extension surface 716 extending in parallel with the receiving groove 714. The extension surface 716 extends in one side direction with respect to the receiving groove 714 so that the first connection member 710 may stably support other member or provide a contact area capable of being stably supported on the other member.

In addition, the connection member 700 may include the first connection member 710 and a second connection member 720 for connecting the first hinge member 40 thereto. The second connection member 720 may be interposed between the first connection member 710 and the first hinge member 40. Of course, the first hinge member 40 may be structurally directly or indirectly couple to the second hinge member 200 through the second connection member 720.

The second connection member 720 may include a first support surface 722 for supporting the extension surface 716 and a second support surface 724 seated to the connection piece 46. It is preferable that the first and second support surfaces 722 and 724 are arranged to have a predetermined area so as to securely couple the extension surface 716 and the connection piece 46.

The first support surface 722 and the extension surface 716 may be fixed by screw coupling. Similarly, the second support surface 724 and the connection piece 46 may be fixed by screw coupling. That is, the first support surface 722, the extension surface 716, the second support surface 724, the extension piece 46 may be coupled to each other through holes formed thereon.

The second connection member 720 may include connection support surfaces 726 and 728 connecting the first and second support surfaces 722 and 724. The connection support surfaces 726 and 728 may be formed to have different planes from each other. In this case, the connection support surfaces may include a first connection support surface 726 extending perpendicular to the first support surface 722 and a second connection support surface 728 extending to have a predetermined angle relative to the second support surface 724.

That is, the second connection member 720 may be generally classified into the first support surface 722, the first connection support surface 726, the second connection support surface 728, and the second support surface 724. The respective surfaces are arranged to have a predetermined angle different from each other, so that it may be possible to reduce various vibrations generated by the second hinge member 200. Since the second connection member 720 has a shape which occupies a predetermined space and is bent in three dimensions, it may be possible to provide rigidity capable of reducing noise and vibration which are generated by rotation of the container 100 and are transferred to the first hinge member 40 by the second hinge member 200.

In other words, the second connection member 720 includes the connection support surfaces 726 and 728 interposed between the first and second hinge members 40 and 200, and may reduce the loads or vibration transferred through the connection support surfaces 726 and 728 and distribute the loads or vibration into the door. The connection support surfaces 726 and 728 include through holes 729, and the entirety of the connection support surfaces 726 and 728 is provided within the door. The connection support surfaces 726 and 728 may formed in a plate shape. That is, the connection support surfaces 726 and 728 may be formed in a plate shape having a wide surface facing the front surface of the door. Thus, each of the connection support surfaces 726 and 728 may be a planar portion.

Accordingly, the entirety of the connection support surfaces 726 and 728 may be buried in the thermal insulator 256 foamed within the door, and the thermal insulator 256 may pass through the through holes 729. Thus, it may be possible to uniformly distribute the loads transferred through the second hinge member 200 into the door.

Meanwhile, the connection member 700 may include a second hinge bush 740. The second hinge member 200 may be seated to the second hinge bush 740. That is, the second hinge member 200 may be seated on a seating surface of the second hinge bush 740. Accordingly, the upper portion of the second hinge bush 740 may form the mounting surface 232*a* of the receiving portion 232 described above. Of course, a portion of the inside panel 254 of the door may be configured to cover the upper portion of the second hinge bush 740. Accordingly, the second hinge bush 740 of the present embodiment may correspond to the mounting member 270 of the above-mentioned embodiment.

The second hinge bush 740 may include a protruding protrusion 742 received in the receiving groove 714. The protruding protrusion 742 may have a shape corresponding to the shape of the receiving groove 714.

In addition, one side of the protruding protrusion 742 may be formed with a rib 744 protruding by a predetermined height. The rib 744 may extend to be greater than a radius of the protruding protrusion 742, and may extend radially with respect to the protruding protrusion 742. The rib 744 is inserted into the through hole 718 so that the operator may easily recognize a coupling position and direction between the second hinge bush 740 and the first connection member 710.

Meanwhile, the protruding protrusion 742 may have the same center as the rotary shaft 42 of the first hinge member 40. In this case, the protruding protrusion 742 may be formed therein with a separate receiving groove into which the rotary shaft 206 of the second hinge member 200 may be inserted. Accordingly, the second hinge member 200 may be rotatably supported by the second hinge bush 740.

The rotary shaft 206 of the second hinge member 200 is inserted into the second hinge bush 740 such that the second hinge member 200 may be rotatably installed to the second hinge bush 740.

On the other hand, the seating groove 44, the seating protrusion 712, the receiving groove 714, and the protruding protrusion 742 may arranged so as not to have the same center as the rotary shaft 42 of the first hinge member 40 and the rotary shaft 206 of the second hinge member 200. However, the seating groove 44, the seating protrusion 712, the receiving groove 714, and the protruding protrusion 742 have to be arranged together so as to come into contact with and be coupled to each other, such that the first hinge member 40 may be coupled to the first connection member 710 and the first connection member 710 may be coupled to the second hinge bush 740.

That is, when the connection member 700, the first hinge member 40, and the second hinge member 200 are connected to each other, the rotary shaft 42 of the first hinge member 40 and the rotary shaft 206 of the second hinge member 200 may be arranged to have the same center.

The second hinge bush 740 may be provided with a fixed portion 745. The fixed portion 745 may be provided so as to couple the second hinge bush 740 to the inside panel 254 or the outside panel 252 of the door 20. The fixed portion 745 may be provided so as to couple the second hinge bush 740 to the inside panel 254 or the outside panel 252 in the inside of the door 20. Of course, the second hinge bush 740 may also be coupled to the inside panel 254 in the receiving portion 232, and thus the second hinge bush 740 may also form at least a portion of the receiving portion 232 by being coupled to the inside panel 254.

Accordingly, it may be possible to distribute the loads applied to the second hinge member 200 to the door or to the first hinge member 40, through the second hinge bush 740.

Figure 24:
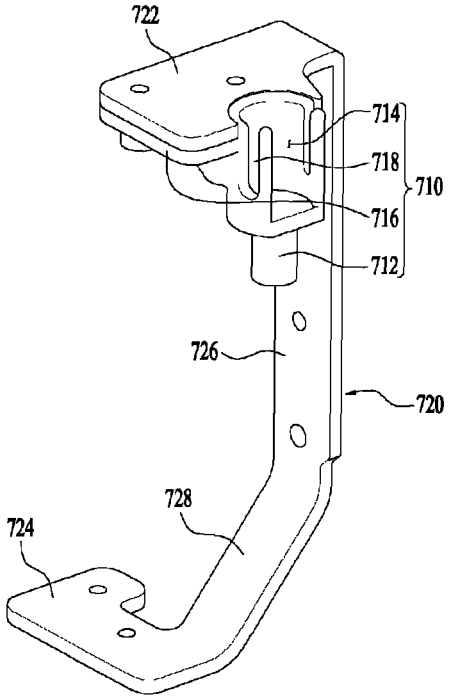
FIG. 24 is a view illustrating a coupled state of the connection member shown in FIG. 23.

FIG. 24 is a view illustrating a coupled state of the first connection member 710 and the second connection member 720 in FIG. 23. Hereinafter, a description will be given with reference to FIG. 24.

The first connection member 710 and the second connection member 720 may be configured of two components.

That is, the extension surface 716 is arranged at a lower side of the first support surface 722, and the first support surface 722 and the extension surface 716 may be coupled while coming into surface contact with each other. Accordingly, loads applied to the first connection member 710 through the second hinge member 200, namely loads of the second hinge member 200 and the container 100 may be transferred to the first hinge member 40 through the first support surface 722. That is, it may be possible to increase a transfer area.

In addition, since a portion at which the second connection member 720 comes into contact with the first hinge member 40 and a portion at which the first connection member 710 comes into contact with the first hinge member 40 differ from each other, the loads of the second hinge member 200 and the container 100 may be distributed and transferred to the first hinge member 40.

In addition, since the first hinge member 40 and the second hinge member 200 have a three-dimensional shape and are supported by pillar shapes spaced apart from each other, instead of being connected on one line, it may be possible to reduce vibration applied to the second hinge member 200 and to improve support rigidity of generated torque.

On the other hand, the first connection member 710 and the second connection member 720 may also be configured of one integral component as shown in FIG. 24. Even when the first connection member 710 and the second connection member 720 are configured of an integral component, a plurality of contact portions with the first hinge member 40 are present. Therefore, it may be possible to distribute the loads of the container 100 and the second hinge member 200 to the first hinge member 40.

Figure 25:
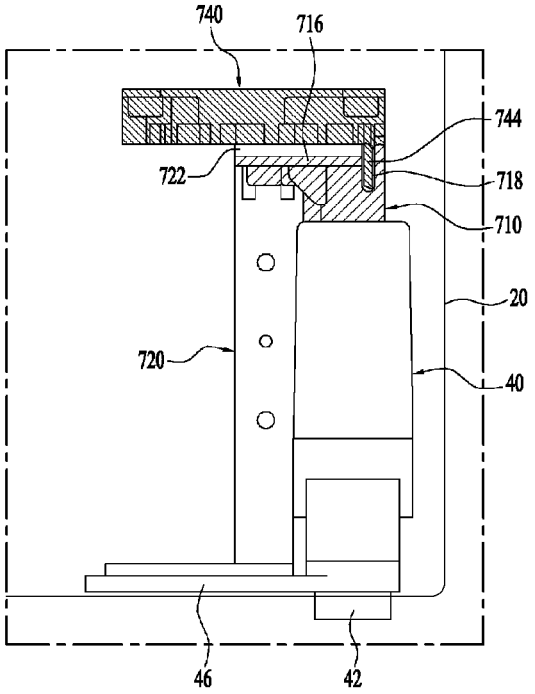
FIG. 25 is a cross-sectional view illustrating a coupled state of the connection member shown in FIG. 23.

FIG. 25 is a cross-sectional view illustrating a coupled state of the components shown in FIG. 23. Hereinafter, a description will be given with reference to FIG. 25. The second hinge member 200 is omitted in FIG. 25.

The second hinge bush 740 is arranged at the upper portion of the second connection member 720, and the first support surface 722 of the second connection member 720 is arranged at the upper side of the extension surface 716 of the first connection member 710.

The first connection member 710 is arranged at the upper side of the first hinge member 40, and the second support surface 724 of the second connection member 720 is seated to the connection piece 46.

That is, the second hinge member 200 and the first hinge member 40 are fixed to be connected to each other through the second hinge bush 740, the first connection member 710, the second connection member 720. Accordingly, the operator may easily select installation positions of the second hinge bush 740, the first connection member 710, and the second connection member 720, and to improve accuracy of operation.

In this case, the connection member 700 may be provided to be buried within the door 20. That is, since the connection member 700 is not exposed to the outside, the user may not recognize the presence of the connection member 700.

Typically, in a case where the door 20 is manufactured, after necessary components are inserted within the door 20, a foaming solution is injected and then foaming is performed by heating. Such a foaming process takes a long time, and the foaming solution may be locally moved within the door 20 in the foaming process. That is, due to phase change of the foaming solution filled within the door 20, the positions of the components arranged within the door 20 may be changed.

For example, if components for fixing the first and second hinge members 40 and 200 are not connected to each other, positions of the components for fixing the first and second hinge members 40 and 200 may be changed during performing of foaming. In this case, since the rotary shaft 42 of the first hinge member 40 and the rotary shaft 206 of the second hinge member 200 are not arranged on one extension line, the rotary shaft 42 of the first hinge member 40 and the rotary shaft 206 of the second hinge member 200 may not be arranged to have the same center of rotation.

However, according to the present invention, since the rotary shaft 42 of the first hinge member 40 and the rotary shaft 206 of the second hinge member 200 are physically coupled to each other through the connection member 700 and the connected relation may be maintained, the rotary shaft 42 of the first hinge member 40 and the rotary shaft 206 of the second hinge member 200 may be arranged to have the same center of rotation in spite of various dangerous factors generated during the foaming process.

That is, since the first hinge member 40 and the second hinge member 200 are pre-coupled through the connection member 700 before performing of the foaming, stable coupling may be obtained and the relative position may not be changed regardless of the foaming. Of course, this may be similarly applied to the connection support member 260 of the above-mentioned embodiment as well as the present embodiment. That is, before the foaming is performed, since the first hinge member 40 is directly or indirectly coupled to the second hinge member 200 and the relative position between the first hinge member 40 and the second hinge member 200 are fixed through the connection support member 260, the centers of the rotary shafts 42 and 206 are not distorted.

Accordingly, it may be possible to more effectively obtain concentricity between the rotary shaft 42 of the first hinge member 40 and the rotary shaft 206 of the second hinge member 200.

Meanwhile, the foaming solution filled within the door 20 is difficult to obtain sufficient rigidity during the foaming process compared to plastic or steel. Accordingly, the present invention transfers loads applied to the second hinge member 200 to the first hinge member 40 instead of any component, so that the container 100 may be stably supported by the door 20 and be stably rotated.

Figure 26:
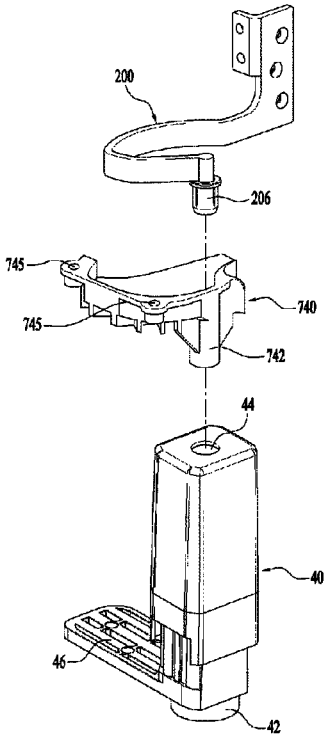
FIG. 26 is an exploded perspective view illustrating still another embodiment of a connection member.

FIG. 26 is an exploded perspective view illustrating a simplified embodiment of the embodiment described in FIG. 23.

In the present embodiment, the connection member 700 may be configured of only a second hinge bush 740. That is, unlike the above-mentioned embodiment, the connection member 700 may not include the first and second connection members.

In this case, the second hinge bush 740 may have a shape similar to that of the above-mentioned embodiment. The second hinge bush 740 may have a protruding protrusion 742. The protruding protrusion 742 extends downwardly with respect to the second hinge bush 740.

The first hinge member 40 is formed with a seating groove 44 into which the protruding protrusion 742 is inserted. The seating groove 44 has a shape corresponding to the protruding protrusion 742. Therefore, when the refrigerator is assembled, the user may easily insert the protruding protrusion 742 into the seating groove 44.

The rotary shaft 42 of the first hinge member 40 and the rotary shaft 206 of the second hinge member 200 may be arranged to have the same center of rotation by the second hinge bush 740.

Meanwhile, the protruding protrusion 742 and the seating groove 44 may have the same center as the rotary shaft 42 of the first hinge member 40 and the rotary shaft 206 of the second hinge member 200. Of course, the protruding protrusion 742 and the seating groove 44 may not also have the same center as the rotary shaft 42 of the first hinge member 40 and the rotary shaft 206 of the second hinge member 200.

If the protruding protrusion 742 and the seating groove 44 do not have the same center as the rotary shaft 42 of the first hinge member 40 and the rotary shaft 206 of the second hinge member 200, the protruding protrusion 742 and the seating groove 44 may function as a fixing means for coupling the second hinge bush 740 and the first hinge member 40.

Figure 27:
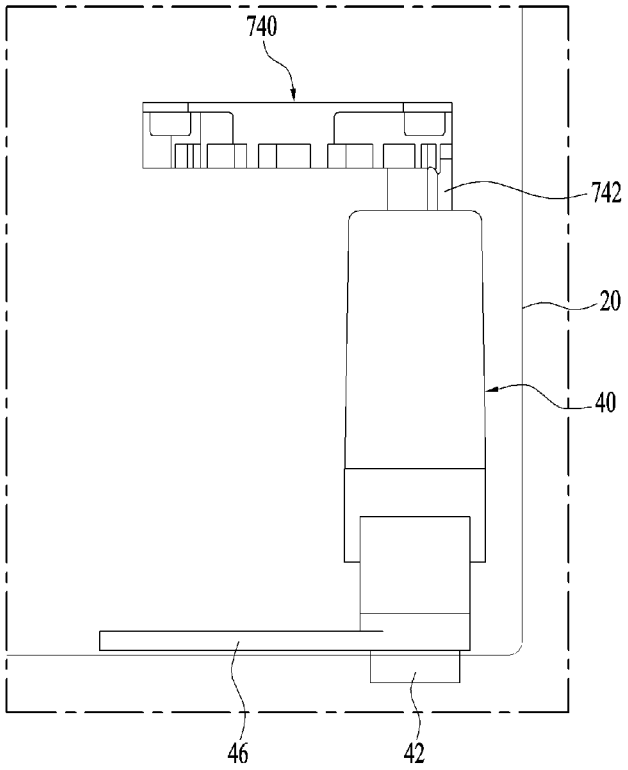
FIG. 27 is a view illustrating a coupled state of the connection member shown in FIG. 26.

FIG. 27 is a view illustrating a coupled state of components shown in FIG. 26. Hereinafter, a description will be given with reference to FIG. 27. The second hinge member 200 is omitted in FIG. 27.

The second hinge bush 740 and the first hinge member 40 are connected to each other so as to form a fixed state. Accordingly, when the foaming process for injecting and foaming a foaming solution into the door 20 is performed, the second hinge bush 740 and the first hinge member 40 are spaced apart from each other. Therefore, it may be possible to prevent misalignment by which the rotary shaft 42 of the first hinge member 40 and the rotary shaft 206 of the second hinge member 200 do not have the same center of rotation.

Meanwhile, the second hinge bush 740 and the first hinge member 40 may be coupled to each other through other configuration fixed within the door 20. The second hinge bush 740 and the first hinge member 40 may be fixed to one integral component. That is, since the second hinge bush 740 and the first hinge member 40 may be individually coupled to the same component in addition to fixing by connection to each other, the second hinge bush 740 and the first hinge member 40 may be further securely fixed to each other. Accordingly, it may be possible to prevent misalignment between the rotary shaft 42 of the first hinge member 40 and the rotary shaft 206 of the second hinge member 200 caused by factors generated during the foaming process or the manufacturing process of the refrigerator.

On the other hand, the second hinge bush 740 and the first hinge member 40 may also be integrally formed. That is, since the second hinge bush 740 and the first hinge member 40 are fixed by one component, the operator may eliminate a process of connecting the second hinge bush 740 and the first hinge member 40.

Various embodiments have been described in the best mode for carrying out the invention.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A refrigerator comprising:

a cabinet defining a first storage region and configured to store food;

a door rotatably connected to the cabinet and configured to opens and closes the first storage region, the door configured to be filled with a thermal insulator;

a gasket provided on an inner surface of the door and configured to define a sealing boundary that seals the first storage region from outdoor air in a state in which the door closes the first storage region;

a first hinge member that comprises a first rotary shaft and that is configured to rotatably connect the door to the cabinet;

a container defining a second storage region configured to store food, the container configured to rotate relative to the door and relative to the cabinet such that the container is received within the first storage region of the cabinet in a state in which the door closes the first storage region;

a second hinge member that comprises a second rotary shaft and that is configured to rotatably connects the door to the container; and a connection member coupled to the second hinge member at a coupling location within a body of the door, the connection member configured to provide support to the second hinge member so as to maintain an axial direction and a position of the second rotary shaft of the second hinge member relative to the first rotary shaft of the first hinge member.

2. The refrigerator according to claim 1, wherein the connection member is provided within the thermal insulator that fills the door.

3. The refrigerator according to claim 2, wherein the connection member is provided with a through-hole configured to provide an opening through which the thermal insulator is inserted to fill the door.

4. The refrigerator according to claim 3, wherein the connection member has a plate shape and comprises a planar portion having a surface that faces toward a front surface of the door.

5. The refrigerator according to claim 4, wherein the through-hole is provided on the planar portion of the connection member.

6. The refrigerator according to claim 1, wherein the door comprises an outside panel defining a front external appearance of the door and an inside panel defining a rear external appearance of the door, and wherein the inside panel and the outside panel define a space therebetween that is configured to be filled with the thermal insulator.

7. The refrigerator according to claim 6, wherein:

the connection member is provided separately from the inside panel, the outside panel, and the thermal insulator, and the connection member is directly or indirectly coupled with at least one of the inside panel or the outside panel within the body of the door so as to distribute a load applied by the second hinge member to the door or to transfer the loads to the first hinge member.

8. The refrigerator according to claim 6, wherein the first hinge member comprises an upper first hinge member provided at an upper portion of the door and a lower first hinge member provided at a lower portion of the door, the second hinge member comprises an upper second hinge member provided at the upper portion of the door and a lower second hinge member provided at the lower portion of the door, and the connection member is configured to vertically extend along one side of the door so as to be connected to both the upper first hinge member and the lower first hinge member or both the upper second hinge member and the lower second hinge member.

9. The refrigerator according to claim 6, comprising a mounting member configured to couple the second hinge member with the connection member within the body of the door, the mounting member configured to be directly coupled to the second hinge member and directly coupled to the connection member.

10. The refrigerator according to claim 9, wherein the mounting member defines a second hinge member receiving portion configured to receive at least a portion of the second hinge member, the at least a portion of the second hinge member having a rotation portion through which the second hinge member rotatably connects the door to the container.

11. The refrigerator according to claim 9, further comprising a bracket fixed to the inside panel of the door and provided between the inside panel of the door and the mounting member.

12. The refrigerator according to claim 6, further comprising a plurality of coupling members that are configured to be coupled with the first rotary shaft of the first hinge member and that extend horizontally along the door at an upper portion of the connection member and at a lower portions of the connection member.

13. The refrigerator according to claim 12, wherein the plurality of coupling members, together with the inside panel of the door and the outside panel of the door, define a space that is configured to be filled with the thermal insulator.

14. The refrigerator according to claim 1, wherein:

the first hinge member comprises an upper first hinge member provided at an upper portion of the door and a lower first hinge member provided at a lower portion of the door, and the second hinge member comprises an upper second hinge member provided at the upper portion of the door and a lower second hinge member provided at the lower portion of the door.

15. The refrigerator according to claim 14, wherein the connection member is provided between the lower first hinge member and the lower second hinge member.

16. The refrigerator according to claim 15, wherein:

the lower second hinge member is provided at a vertical position that is above a vertical position of the lower first hinge member, the lower first hinge member comprises a lower first rotary shaft, the lower second hinge member comprises a lower second rotary shaft, and the connection member connects the lower first rotary shaft with the lower second rotary shaft such that the lower first rotary shaft and the lower second rotary shaft are spaced apart from each other.

17. The refrigerator according to claim 16, further comprising a second hinge bush interposed between the connection member and the second hinge member, the second hinge member being rotatably coupled to the second hinge bush.

18. The refrigerator according to claim 14, wherein:

the lower first hinge member comprises a connection piece fixedly attached to the door; and the connection member is coupled to the connection piece within the body of the door.

19. The refrigerator according to claim 1, wherein a first side of the second hinge member is fixedly attached to the container at an inner side of the sealing boundary towards the inner surface of the door and a second side of the second hinge member is rotatably connected to the door.

20. The refrigerator according to claim 1, wherein the first rotary shaft of the first hinge member is provided at an outer side of the sealing boundary towards an outer surface of the door, the first rotary shaft configured to be vertically aligned with the second rotary shaft of the second hinge member.

21. The refrigerator according to claim 1, further comprising a latch configured to selectively couple the container with the door, wherein:

in a state in which the latch couples the container with the door, the container and the door are configured to be opened simultaneously, and in a state in which the latch decouples the container from the door, the door is configured to be opened independently of the container.

22. The refrigerator according to claim 1, further comprising a fixing device configured to selectively couples the container to the cabinet, the fixing device being provided at an upper portion of the container at a lateral side of the container that is opposite to a position of the second hinge member, the fixing device configured to additionally support the container within the first storage region, together with the second hinge member.

23. A refrigerator comprising:

a cabinet defining a first storage region and configured to store food;

a door rotatably connected to the cabinet and configured to open and close the first storage region, the door configured to be filled with a thermal insulator;

a gasket provided on an inner surface of the door and configured to define a sealing boundary that seals the first storage region from outdoor air in a state in which the door closes the first storage region;

a first hinge member that comprises a first rotary shaft and that is configured to rotatably connects the door to the cabinet;

a container defining a second storage region configured to store food at an inner side of the sealing boundary, the container configured to rotate relative to the door and relative to the cabinet such that the container is selectively received within the first storage region;

a second hinge member that comprises a second rotary shaft and that is configured to rotatably connect the door relative to the container, the second hinge member being rotatably connected to the door and being connected to the container at an inner side of the sealing boundary toward the inner surface of the door; and a connection member coupled to the second hinge member at a coupling location within a body of the door, the connection member being configured to provide support to the second hinge member so as to maintain an axial direction and a position of the second rotary shaft of the second hinge member relative to the first rotary shaft of the first hinge member, wherein a rotation trajectory space region defined by a rotation of the container relative to the door is configured to be within a rotation trajectory space region defined by a rotation of the door relative to the cabinet, such that the container is received in the first storage region in a state in which the door closes the first storage region.

24. A refrigerator comprising:

a cabinet having at least one storage chamber configured to store food;

a first hinge member comprising a first fixed portion at a first end thereof and a first rotation portion at a second end thereof, the first fixed portion being fixedly supported by the cabinet;

at least one door comprising an outer surface facing away from the at least one storage chamber and an inner surface facing toward the at least one storage chamber in a state in which the at least one door closes the at least one storage chamber, the at least one door configured to be filled with a thermal insulator between the outer surface and the inner surface of the door, the at least one door being rotatably connected to a rotary shaft of the first hinge member to open and close the at least one storage chamber, the at least one door being configured to rotate relative to the cabinet and having a gasket defining a sealing boundary on the inner surface of the at least one door in a state in which the at least one door closes the at least one storage chamber;

a container defining an auxiliary storage region configured to be selectively separated from the at least one storage chamber, the container configured to be received within the at least one storage chamber of the cabinet in a state in which the at least one door closes the at least one storage chamber;

a second hinge member comprising a second fixed portion at a first end thereof, a second rotation portion at a second end thereof, and a connection portion connecting the second fixed portion and the second rotation portion, the second fixed portion being fixedly supported by the container, and the second rotation portion being rotatably connected with the at least one door at an inner side of the sealing boundary toward the inner surface of the door, the second hinge member being configured to selectively decouple the container from the cabinet such that the container is decoupled from the cabinet together with the door or the container is decoupled from the cabinet independently of the door; and a connection member connected to the second rotation portion of the second hinge member, at least a portion of the connection member being configured to extend into the thermal insulator of the door.

25. The refrigerator according to claim 24, wherein the sealing boundary of the door is provided therein with a second hinge member receiving portion that is configured to receive the second rotation portion of the second hinge member.

26. The refrigerator according to claim 25, wherein the connection member is connected to the second rotation portion of the second hinge member through the second hinge member receiving portion.

27. The refrigerator according to claim 25, wherein the second rotation portion of the second hinge member is vertically aligned with the first rotation portion of the first hinge member at an outer side of the sealing boundary.

28. The refrigerator according to claim 27, wherein at least a portion of the first rotation portion of the first hinge member is arranged to overlap with at least a portion of the second rotation portion of the second hinge member.

29. The refrigerator according to claim 28, wherein a portion of the second hinge member receiving portion extends over the gasket from the inner side of the sealing boundary to a portion between the outer surface of the door and the inner surface of the door.

30. The refrigerator according to claim 29, wherein:

the gasket comprises a fixed portion of which at least a portion is fixedly inserted into the door; and the second rotation portion of the second hinge member is provided at a position of the second hinge member receiving portion that is biased toward an outer side of the sealing boundary relative to a center of the fixed portion of the gasket.

31. The refrigerator according to claim 27, wherein the at least a portion of the connection member that extends into the thermal insulator is configured to extend to connect with the first rotation portion of the first hinge member.

32. The refrigerator according to claim 31, further comprising a plurality of coupling members that extend horizontally along the door, at least a portion of the plurality of coupling members being exposed to an outside of the door and intersecting with the connection member, the plurality of coupling members being connected to the first rotation portion of the first hinge member and to the connection member.

33. The refrigerator according to claim 32, wherein the plurality of coupling members, together with the inner surface of the door and the outer surface of the door, define a space in which the thermal insulator is filled.

34. The refrigerator according to claim 24, wherein the second hinge member of the container comprises an upper second hinge member provided at an upper portion of the door and a lower second hinge member provided at a lower portion of the door, the upper second hinge member and the lower second hinge members being rotatably supported at an inner side of the sealing boundary toward the inner surface of the door, and at least a portion of the connection member being configured to connect the upper second hinge member and the lower second hinge members.

35. The refrigerator according to claim 34, wherein the at least a portion of the connection member that extends into the thermal insulator of the door is configured to further extend to connect with the first rotation portion of the first hinge member.

36. The refrigerator according to claim 24, wherein the connection member extends between the outer surface of the door and the inner surface of the door in a vertical direction along the door, and the connection member comprises at least one first planar portion that is substantially parallel with the outer surface of the door.

37. The refrigerator according to claim 36, wherein the connection member extends between the outer surface of the door and the inner surface of the door in a vertical direction along the door, and the connection member comprises at least one second planar portion that substantially intersects with the outer surface of the door.

38. The refrigerator according to claim 37, wherein the at least one second planar portion comprises a bending portion that is bent from the at least one first planar portion to substantially intersect with the outer surface of the door.

39. The refrigerator according to claim 37, wherein the connection member is provided with a recess defined in the at least one first planar portion.

40. The refrigerator according to claim 37, wherein the connection member is provided with at least one through-hole defined on the at least one first planar portion and the at least one second planar portion such that the thermal insulator is filled through the through hole.

* * * * *